US005615877A

United States Patent [19]

Watanabe et al.

[11] Patent Number: 5,615,877

[45] Date of Patent: Apr. 1, 1997

[54] SHEET TRANSPORTING DEVICE FOR USE IN AN IMAGE FORMING APPARATUS

[75] Inventors: Takeshi Watanabe; Kikunosuke Tsuji; Setsuo Hori; Seiji Kado; Kenichi Satake; Hiromi Nakatsu; Kohichi Baba; Masayuki Ishii; Yoshiko Uriu, all of Osaka, Japan

[73] Assignee: Mita Industrial Co., Ltd., Osaka-fu, Japan

[21] Appl. No.: 445,967

[22] Filed: May 22, 1995

[30] Foreign Application Priority Data

May 26, 1994 [JP] Japan ..... 6-112513

[51] Int. Cl.[6] ..... B65H 7/02

[52] U.S. Cl. ..... 271/259

[58] Field of Search ..... 271/259, 261, 271/227, 228, 265.03, 240, 205

[56] References Cited

U.S. PATENT DOCUMENTS 3,198,516 8/1965 Withorn et al. ..... 271/272

3,947,020 3/1976 Kobayashi ..... 271/197

4,886,967 12/1989 Itakura ..... 271/227

*Primary Examiner*—William E. Terrell

*Assistant Examiner*—T. Kelly

*Attorney, Agent, or Firm*—Jordan and Hamburg

[57] ABSTRACT

A sheet transporting device for use in an image forming apparatus includes a first and second sheet transporting members movable in widthwise directions of sheet to be transported, the first sheet transporting member for transporting the sheet in a lengthwise direction of the sheet in contact with one side end portion of the sheet, the second sheet transporting member for transporting the sheet in the lengthwise direction in contact with the other side end portion of the sheet; a moving mechanism for moving the first and second sheet transporting members in widthwise directions of the sheet: a sheet feeder provided at an upstream of the first and second sheet transporting members for holding the sheet temporarily and feeding the sheet to the first and second sheet transporting members; and a controller for controlling the moving mechanism and the sheet feeder to move the first and second sheet transporting members until they come into contact with the sheet while rendering the sheet feeder hold the sheet.

12 Claims, 12 Drawing Sheets

SHEET TRANSPORTING DEVICE FOR USE IN AN IMAGE FORMING APPARATUS

BACKGROUND OF THE INVENTION

This invention relates to a sheet transporting device for use in an image forming apparatus, such as ink jet printing apparatus for printing images generated by facsimile machine, copying machine, printer, computer output device, and the like.

There have been marketed various types of image forming apparatuses. Recently, ink jet printing apparatuses have been marketed in which ink is emitted from nozzles of an ink emission portion to print an image or letter on a surface of a printing sheet. Further, there has been proposed an ink jet printing apparatus which can print images on both sides of a printing sheet.

For example, Japanese Unexamined Patent Publication No. 5-185661 discloses an ink jet printing apparatus including a first ink emission portion for printing an image on the front side of a printing sheet and a second ink emission portion for printing another image on the back side of the sheet which are arranged along a horizontal plane. In this known apparatus, the printing sheet is transported along the horizontal plane by wide transporting belts having a width greater than the width of printing sheet.

Also, Japanese Unexamined Patent Publication No. 5-330037 discloses an ink jet printing apparatus in which ink emission portions are vertically arranged and opposed to each other with respect to a horizontal plane along which a printing sheet is transported. The opposite ink emission portions print images on both sides of a horizontally transported printing sheet. In this apparatus, too, to support the printing sheet, there is provided wide transporting belts having a width greater than the width of printing sheet prior to and after the printing portion.

In these known apparatuses, the printing sheet is supported by belts entirely extending in a direction of width of the printing sheet to prevent flexure of the printing sheet by the weight. Further, the printing sheet is printed with images on the both sides thereof. Accordingly, when the printing sheet is transferred to such wide transporting belt from the printing portion before the ink completely dries out, printed fresh images are liable to be damaged by the belt, and ink of printed fresh images is also liable to smear the belt.

In view of these problems, in ink jet printing apparatuses operable to print images on both sides of a printing sheet, there has been seriously demanded a way of reliably supporting or holding side ends of a printing sheet to make free a center area of the printing sheet onto which an image is to be printed.

SUMMARY OF THE INVENTION

It is an object of the present invention to provide a sheet transporting device for use in an image forming apparatus which has overcome the problems residing in the prior art.

It is another object of the present invention to provide a sheet transporting device for use in an image forming apparatus which can hold opposite side ends of a sheet reliably to define a support-free center area on a sheet and assure clear both-side image forming.

The present invention is directed to a sheet transporting device for use in an image forming apparatus, the sheet transport device comprising: a first and second sheet transporting members disposed at a predetermined spacing in a widthwise direction of a sheet to be transported, the first sheet transporting member for transporting the sheet in a lengthwise direction of the sheet in contact with one side end portion of the sheet, the second sheet transporting member for transporting the sheet in the lengthwise direction in contact with the other side end portion of the sheet: a sheet feeder provided at an upstream of the first and second sheet transporting members for feeding the sheet to the first and second sheet transporting members; a measure for measuring a first time period in which a first specified portion of the sheet comes from the sheet feeder to a first position defined before the first sheet transporting member and a second time period in which a second specified portion of the sheet comes from the sheet feeder to a second position defined before the second sheet transporting member; a judger for judging whether a difference between the first and second time periods is larger than a predetermined value; and a controller in responsive to the judger for controlling the sheet feeder to suspend the feeding of the sheet to the first and second sheet transporting members when the difference is larger than the predetermined value.

The measure may be provided with a first sheet detector provided at the first position and a second sheet detector provided at the second position.

The sheet transporting device may be further provided with a first carriage for carrying the first sheet transporting member and the first sheet detector; a second carriage for carrying the second sheet transporting member and the second sheet detector; a moving mechanism for moving the first and second carriages in widthwise directions of the sheet.

The first and second sheet transporting members each may include a pair of endless belts.

Also, the present invention is directed to a sheet transporting device for use in an image forming apparatus, the sheet transporting device comprising: a first and second sheet transporting members movable in widthwise directions of a sheet to be transported, the first sheet transporting member for transporting the sheet in a lengthwise direction of the sheet in contact with one side end portion of the sheet, the second sheet transporting member for transporting the sheet in the lengthwise direction in contact with the other side end portion of the sheet; a moving mechanism for moving the first and second sheet transporting members in widthwise directions of the sheet; a sheet feeder provided at an upstream of the first and second sheet transporting members for holding the sheet temporarily and feeding the sheet to the first and second sheet transporting members; and a controller for controlling the moving mechanism and the sheet feeder to move the first and second sheet transporting members until they come into contact with the sheet while controlling the sheet feeder hold to the sheet.

The controller may be provided with a first sheet detector for detecting the one side end portion of the sheet and a second sheet detector for detecting the other side end portion of the sheet, and the first and second sheet detectors are provided before the sheet feeder. It may be preferable that each of the first and second sheet detectors includes a plurality of detecting sections arranged in a widthwise direction of the sheet.

The sheet transporting device may be further provided with a first carriage for carrying the first sheet transporting member and the first sheet detector; a second carriage for carrying the second sheet transporting member and the second sheet detector. The moving mechanism may be provided with a first moving portion for moving the first carriage in a first widthwise direction of the sheet; and a second moving portion for moving the second carriage in a second width direction opposite to the first widthwise direction.

Also, the sheet transporting device may be further provided with a measure for measuring a first time period in which a first specified portion of the sheet comes from the sheet feeder to a first position defined before the first sheet transporting member and a second time period in which a second specified portion of the sheet comes from the sheet feeder to a second position defined before the second sheet transporting member; a judger for judging whether a difference between the first and second time periods is larger than a predetermined value; and a secondary controller in responsive to the judger for controlling the sheet feeder to suspend the feeding of the sheet to the first and second sheet transporting members when the difference is larger than the predetermined value. The measure may include a third sheet detector provided at the first position and a fourth sheet detector provided at the second position.

Further, it may be preferable to provide a first carriage for carrying the first sheet transporting member, the first sheet detector, and the third sheet detector: a second carriage for carrying the second sheet transporting member, the second sheet detector, and the fourth sheet detector; and a moving mechanism for moving the first and second carriages in widthwise directions of the sheet.

With thus constructed sheet transporting device, a sheet is fed to the first and second sheet transporting members for transporting the sheet in contact with the opposite side end portion of the sheet. Accordingly, a center portion of the sheet comes into no contact with any member to provide an image forming free zone. This is advantageous for the both-side image forming.

Also, measurement is carried out about a first time period in which a first specified portion of the sheet comes from the sheet feeder to the first position defined before the first sheet transporting member and a second time period in which a second specified portion of the sheet comes from the sheet feeder to the second position defined before the second sheet transporting member. It is judged whether a difference between the first and second time periods is larger than a predetermined value. If the difference is larger than the predetermined value, the sheet feeding is suspended. The measurement and judgment will detect a sheet being fed out of a true course, and then prevent such displaced sheet from being nipped between the first and second transporting members. Thus, jamming can be assuredly eliminated.

Further, the first and second sheet transporting members are moved widthwise directions by the moving mechanism until they come into contact with the sheet while the sheet is temporarily held by the sheet feeder. This will make is possible to transport sheets of different widths because the first and second sheet transporting members are moved by the moving mechanism.

Moreover, there are provided the first and second sheet detectors for detecting the opposite side end portions of the sheet before the sheet feeder. Accordingly, the opposite side end portions of the sheet can be assuredly made in contact with the first and second transporting members.

The sheet detector is constructed by a plurality of detecting sections arranged in a widthwise direction of the sheet. Accordingly, the side end portion of a sheet can be detected at a high accuracy.

There are provided the first and second carriages for carrying the first and second transporting members and the first and second sheet detectors, respectively. This will enable the detection of the sheet end portions and the movement of transporting members to be carried out at a reduced time.

The moving mechanism includes the first moving portion for moving the first carriage and the second moving portion for moving the second carriage to enable the first and second carriages to be moved separately. Accordingly, even if a sheet is shifted in a widthwise direction, the first and second transporting members can be reliably made in contact with respective side end portions of the sheet by moving the first and second carriages separately.

The above and other objects, features and advantages of the present invention will become more apparent upon a reading of the following detailed description and drawings.

DETAILED DESCRIPTION OF THE PREFERRED EMBODIMENTS OF THE INVENTION

Figure 1:
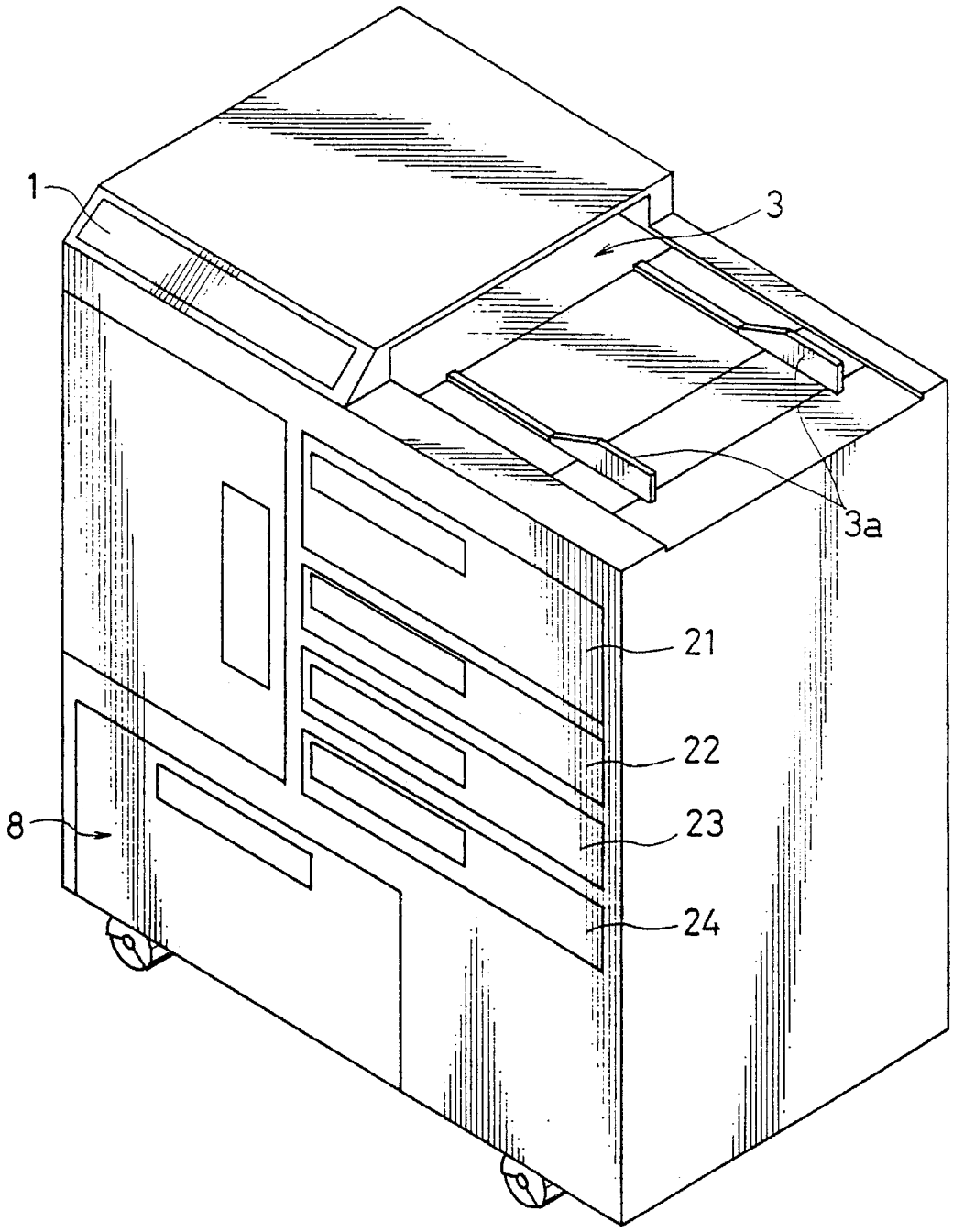
FIG. 1 is a perspective view of an external appearance of an ink jet printing apparatus provided with a sheet transporting device embodying the invention.
Figure 2B:
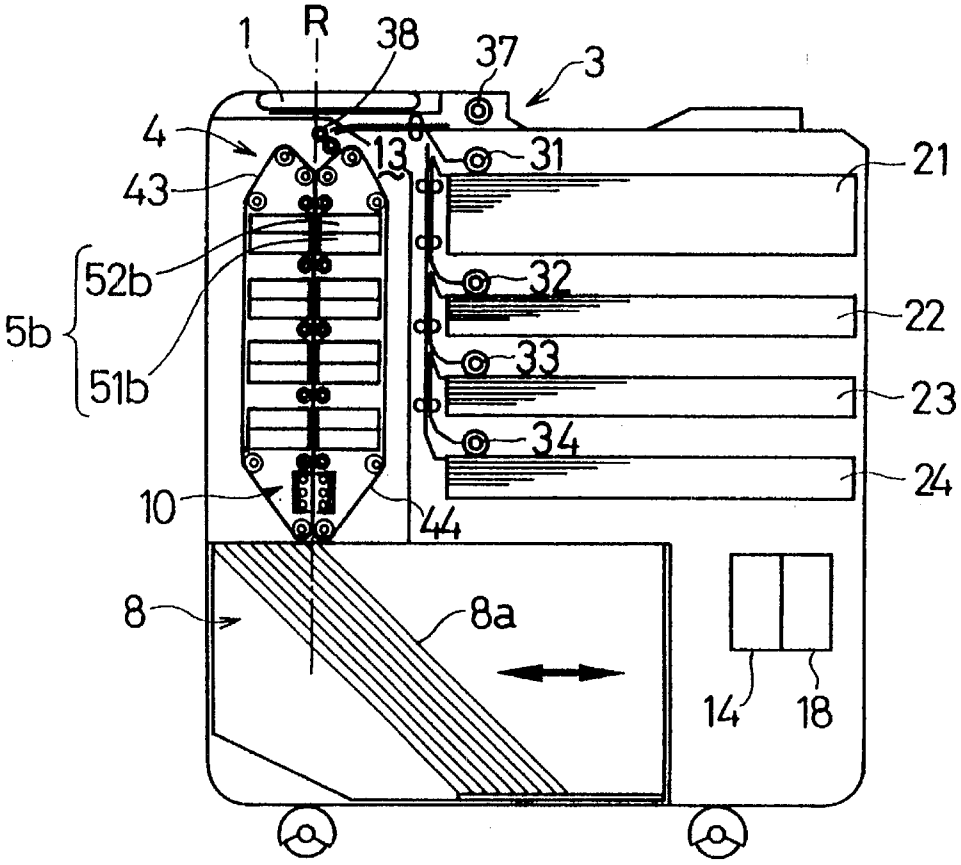
FIG. 2B is a schematic front sectional view showing the internal arrangement of the ink jet printing apparatus.
Figure 2A:
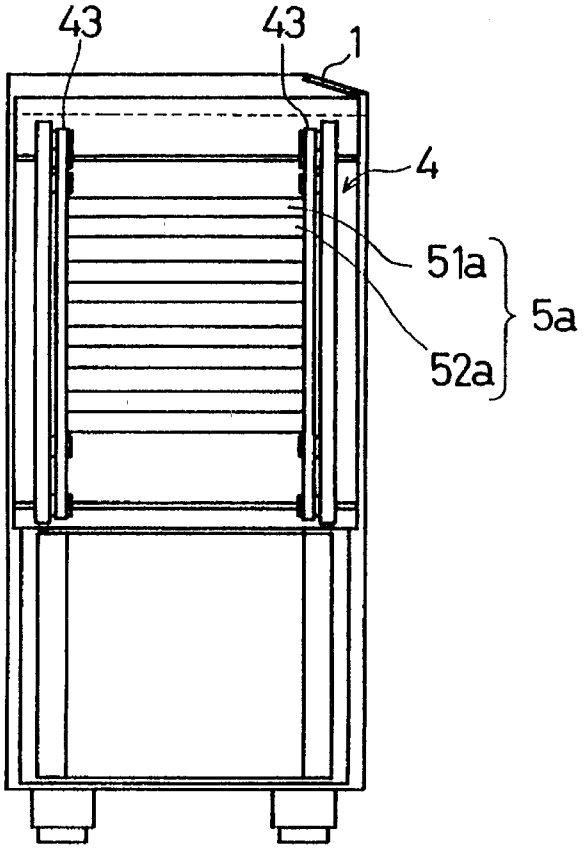
FIG. 2A is a schematic left side sectional view showing an internal arrangement of the ink jet printing apparatus.
Figure 3B:
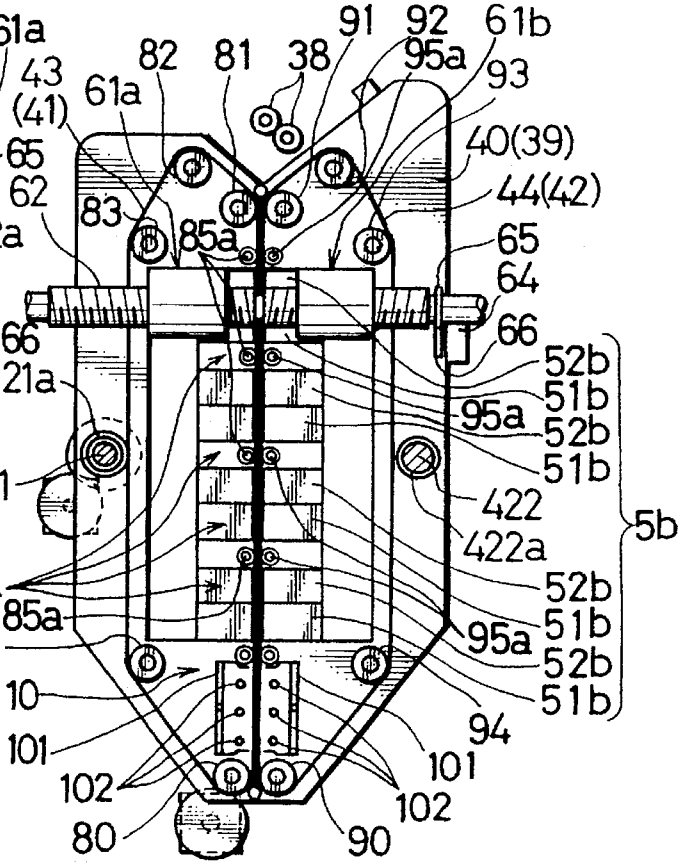
FIG. 3B is a front sectional view showing the printing arrangement.
Figure 3A:
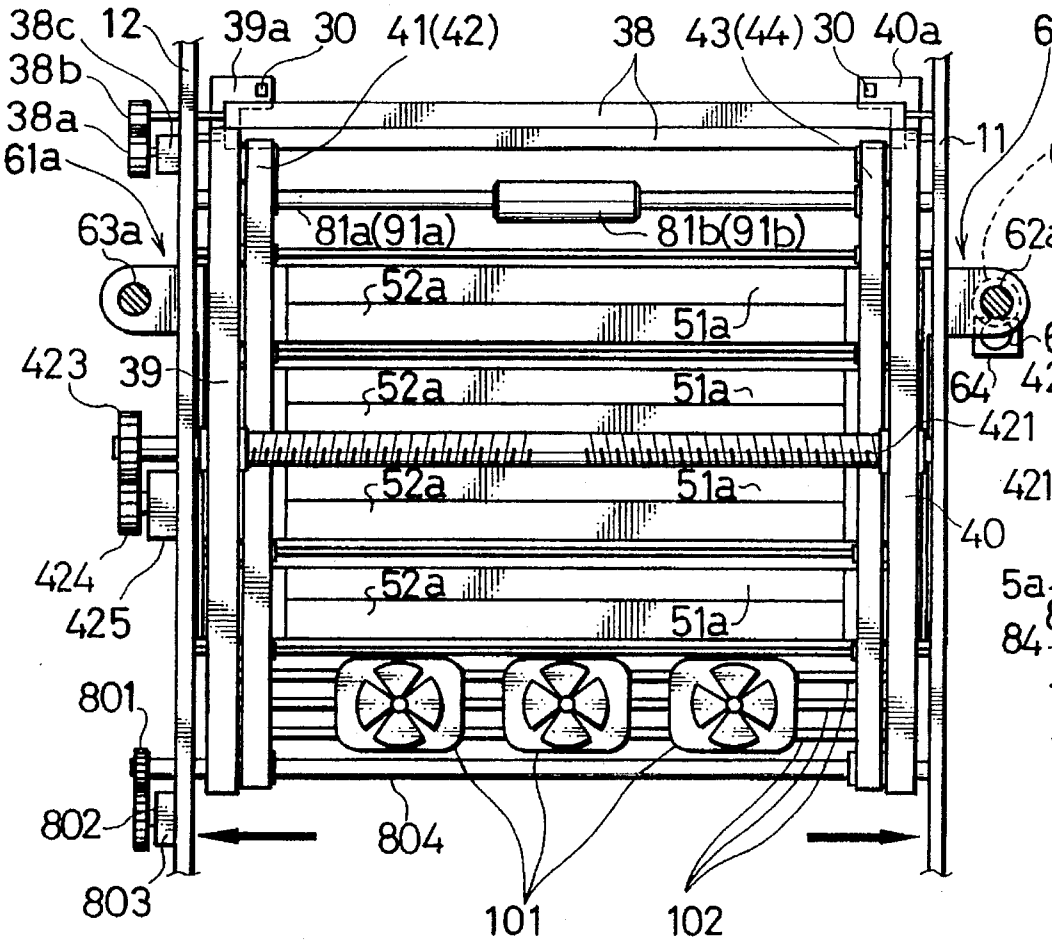
FIG. 3A is a left side sectional view showing a printing arrangement of the ink jet printing apparatus.

An ink jet printing apparatus provided with a sheet transporting device embodying the present invention will be described with reference to the drawings. FIG. 1 is a perspective view showing an external appearance of the ink jet printing apparatus. FIGS. 2A and 2B are schematic diagrams showing an internal arrangement of the ink jet printing apparatus: FIG. 2A showing a left side elevation view; and FIG. 2B showing a front elevation view. FIG. 3A is a left side sectional view showing a printing arrangement in the ink jet printing apparatus; and FIG. 3B is a front sectional view showing the printing arrangement.

It should be appreciated that a direction from right to left or left to right in FIG. 2A is referred to as "a widthwise direction of the apparatus", and a direction from right to left or left to right in FIG. 2B is referred to as "a lengthwise direction of the apparatus".

The ink jet printing apparatus is connected with an unillustrated image generator such as personal computers to print an image generated in the image generator on a printing sheet P.

Referring to FIG. 2B, the ink jet printing apparatus includes a printing sheet storage portion in a right side thereof, a printing arrangement 4 in a left side, and a printing sheet transport assembly 13 between the printing sheet storage portion and the printing arrangement 4.

The printing sheet storage portion includes a plurality of cassettes 21 to 24 for storing different sized printing sheets respectively. The printing sheet transport assembly 13 transports a printing sheet P dispensed from one of the cassettes 21 to 24 in the printing sheet storage portion to the printing arrangement 4 where an image is printed on either side of the printing sheet P or on both sides of the printing sheet P.

The ink jet printing apparatus is further provided with a sorter 8 below the printing arrangement 4. The sorter 8 includes a plurality of bin trays 8*a* stacked horizontally one over another by a specified distance. Driven by an unillustrated spiral cam, the bin trays 8*a* are moved upward and downward one by one to sort out printing sheets having printing images. The ink jet printing apparatus is further provided with an operation panel 1 and a printing sheet bypass portion 3 at an appropriate position on a top surface thereof.

Figure 7:
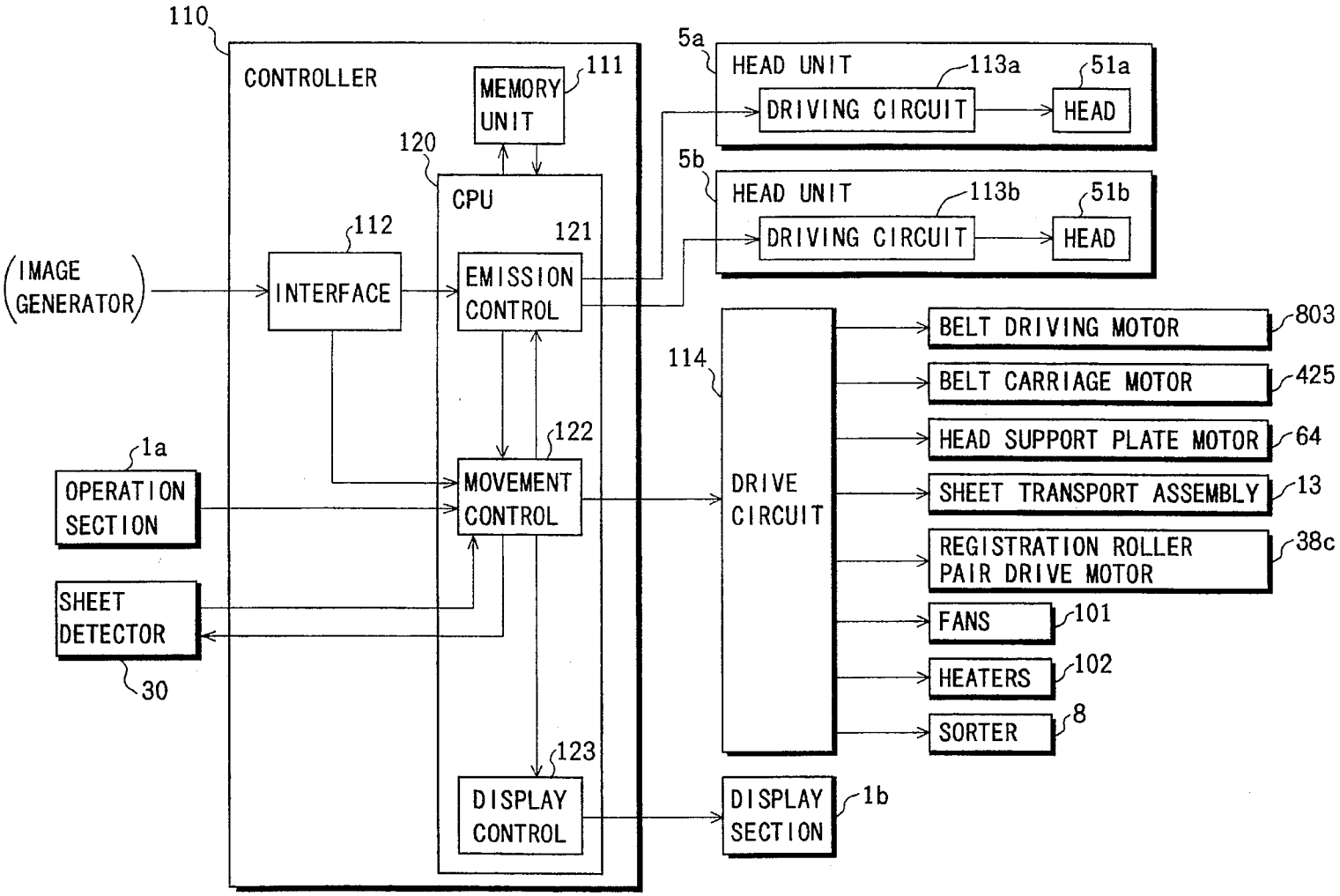
FIG. 7 is a block diagram showing a control system of the ink jet printing apparatus.

The operation panel 1 includes an operation section 1*a* and a display section 1*b* as shown in FIG. 7. The operation section 1*a* is arranged with various key portions including a pressure stabilizing key for activating pressure stabilization of ink to be emitted. The display section 1*b* is made of an LCD (Liquid Crystal Display) or an LED (Light Emitting Diode) and adapted for displaying contents of printing instructions and for warning an operator that the printing sheet P being transported has jammed.

The printing sheet bypass portion 3 includes a sheet alignment mechanism 3*a*. When manually supplying a printing sheet or a stack of printing sheets, insertion position of printing sheet is defined by the sheet alignment mechanism 3*a*.

The plurality of cassettes 21 to 24 are arranged one over another. In this embodiment, for example, the cassette 21 contains printing sheets of A4 size with the longer side thereof in parallel with the lengthwise direction of the apparatus; the cassette 22 contains printing sheets of A3 size with the longer side thereof in parallel with the lengthwise direction of the apparatus; the cassette 23 contains printing sheets of B4 size with the longer side thereof in parallel with the lengthwise direction of the apparatus; and the cassette 24 contains printing sheets of B5 size with the longer side thereof in parallel with the widthwise direction of the apparatus.

It may be possible to place printing sheets of a size other than the above-mentioned sizes in the cassette, and place the longer side of printing sheets in parallel with the widthwise direction of the apparatus instead of with the lengthwise direction.

The printing sheet transport assembly 13 comprises feed rollers 31 to 34, and 37, transport roller pairs, and a pair of registration rollers 38. The feed rollers 31 to 34 are adapted for dispensing printing sheets from the corresponding cassettes 21 to 24 one by one, and the feed roller 37 feeds a printing sheet being inserted manually through the printing sheet bypass portion 3. A printing sheet P dispensed from the cassettes 21 to 24 or fed through the printing sheet bypass portion 3 is transported downstream by the corresponding transport roller pair.

The printing sheet P is temporarily nipped between a drive roller and a driven roller of the registration roller pair 38. After a skew transport of the printing sheet P is corrected, if any, the drive roller of the registration roller pair 38 starts rotating in a forward direction to transport the printing sheet P in timed relation with ink jet operation to the printing arrangement 4. Namely, after a predetermined time period is counted after the driving of the registration roller pair 38, an ink jet operation is started.

The printing arrangement 4 includes a printing sheet transport mechanism, a printing mechanism, and a dryer. The printing sheet transport mechanism includes driving transport belts 41, 43 located on a left side of the printing arrangement 4 in FIG. 2B and includes driven transport belts 42, 44 located on a right side thereof. The printing mechanism includes on the left side of the printing arrangement 4 four printing head units 5*a*. and on the right side four printing head units 5*b*. The four printing head units 5*a* are arranged vertically one over another by a specified distance on the left side, while the four printing head units 5*b* are arranged vertically one over another by a specified distance on the right side.

The driving transport belt 43 is stretched vertically around a front end of the printing head unit 5*a*, and the driving transport belt 41 is stretched vertically around a rear end of the printing head unit 5*a*. The driven transport belt 44 is stretched vertically around a front end of the printing head unit 5*b*, and the driven transport belt 42 is stretched vertically around a rear end of the printing head unit 5*b*. The driving transport belt 41 and the driven transport belt 42 correspond to each other, while the driving transport belt 43 and the driven transport belt 44 correspond to each other.

A printing sheet P transported in the printing arrangement 4 is transported downward in a vertical direction, i.e., in a sheet transport path shown by the phantom line R in FIG. 2B with its front and rear ends nipped between the driving transport belt 43 and the driven transport belt 44 and between the driving transport belt 41 and the rear driven transport belt 42, respectively.

Each printing head unit 5*a* is opposed to each printing head unit 5*b* on a horizontal plane. The printing sheet P is transported vertically downward through the printing arrangement 4, with one side facing the printing head units 5*a* and the other side facing the printing head units 5*b* along a sheet transport path defined by the transport of the driving transport belts 41, 43 and the driven transport belts 42, 44. The dryer adapted for air-drying an ink image on a surface of a printing sheet will be described later.

Figure 4B:
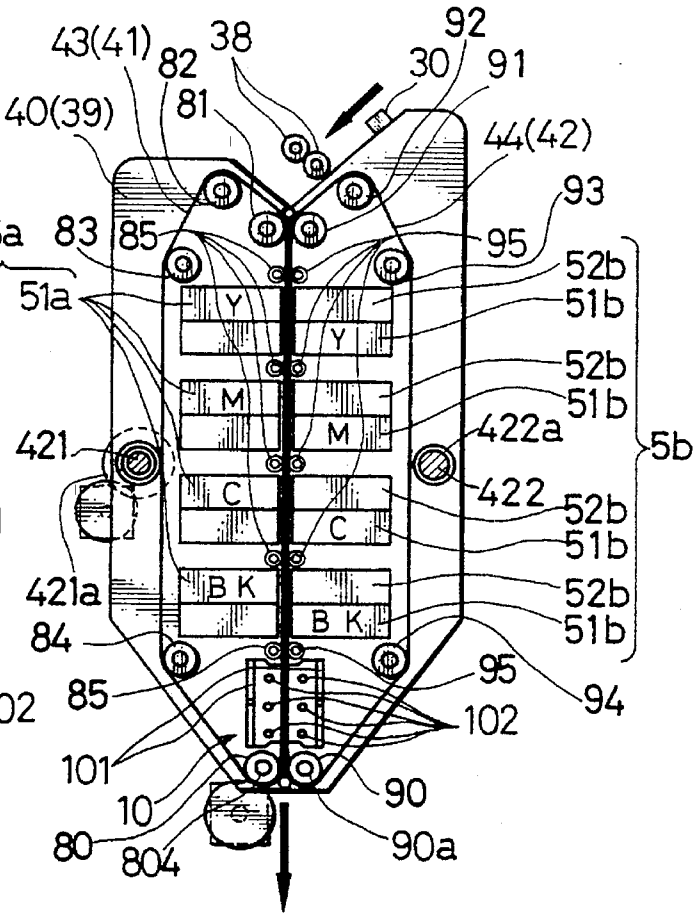
FIG. 4B is a front sectional view showing the printing arrangement with the printing head unit moving mechanism omitted.
Figure 4A:
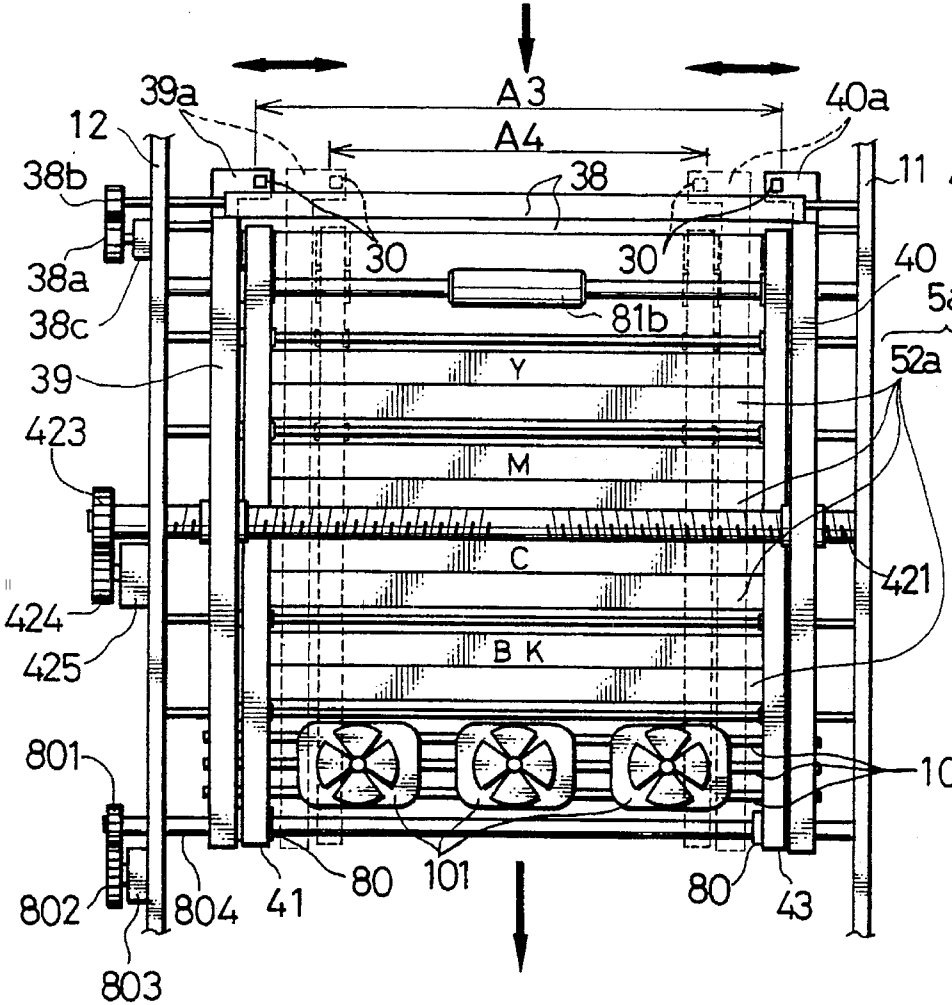
FIG. 4A is a left side sectional view showing the printing arrangement with a printing head unit moving mechanism omitted.

The printing sheet transport mechanism will be described in more detail with reference to FIGS. 3A to 4B. FIG. 3A is a 1 eft side elevation view of the printing arrangement, and FIG. 3B is a front elevation view of the printing arrangement. FIGS. 4A and 4B are similar to FIGS. 3A and 3B and showing the printing arrangement 4 with a printing head unit moving mechanism not illustrated.

It should be noted that in FIGS. 3A and 4A, pulleys 83, 84 are not illustrated for the sake of a clearer description.

The printing sheet transport mechanism has a drive portion and a driven portion. The drive portion is on the left side of the transport path where the driving transport belts 41, 43 are located, while the driven portion is on the right side where the driven transport belts 42, 44 are located.

In the drive portion, the driving transport belts 41, 43 are endless belts and stretched around a drive pulley 80, pulleys 81 to 84, and idle rollers 85, respectively. The transport belts 41, 43 are e.g., made of a polyester meshless cloth material mixed with a chloroprene rubber, resistible to expansion, which accordingly assures stable transportation of printing sheet P in the printing arrangement 4.

In the driven portion, the driven transport belts 42, 44 are also endless belts and stretched around pulleys 90 to 94 and idle rollers 95. The transport belts 42, 44 are made of an elastically flexible material such as urethane rubber and capable of being transported smoothly together with the transport belts 41, 43. The transport belts 41 to 44 have a specified width, e.g., 15 mm, respectively.

A drive shaft 804 is fixedly attached to the pulleys 80 around which the transport belts 41, 43 are stretched respectively. The drive shaft 804 extends in the widthwise direction of the apparatus and is rotatably supported on movable belt carriages 39, 40 to be described later. Front and rear ends of the drive shaft 804 are rotatably supported on front and rear frame walls 11, 12 which are fixedly secured to the apparatus main body.

The drive shaft 804 has a D-shape in cross section, and the drive pulleys 80 are rotated together with rotation of the drive shaft 804. A gear wheel 801 is fixedly secured to the drive shaft 804 and meshes with a gear wheel 802 of a belt driving motor 803. The belt driving motor 803 is a stepping motor. The belt driving motor 803 is rotated by way of the gears 802, 801 to rotate the pulleys 80 and rotate the transport belts 41, 43 forward. With the forward movement of the transport belts 41, 43, the driven transport belts 42, 44 are driven to move forward due to frictional force between the driving transport belt 43 and the driven transport belt 44 and between the driving transport belt 41 and the driven transport belt 42.

Further, the pulleys 81 are attached to a rotary shaft 81*a* rotatably supported on the front and rear frame walls 11, 12, and the idle rollers 85 are rotatably supported by support shafts attached on the movable belt carriages 39, 40. Likewise, the pulleys 90, 91 are attached to rotary shaft 90*a*, 91*a* rotatably supported on the front and rear frame walls 11, 12, respectively, and the idle rollers 85 are rotatably supported by support shafts attached on the movable belt carriages 39, 40.

The rotary shafts in the drive portion and in the driven portion extend in the widthwise direction of the apparatus parallel with one another spaced apart by a specified distance. As mentioned above, the transport belts 41, 43 are stretched around the pulley 80 to 84 and the idle rollers 85, respectively, and the transport belts 42, 44 are stretched around the pulleys 90 to 94, and the idle rollers 95, respectively. Thereby, the belt 43 in the drive portion and the belt 44 in the driven portion are brought into pressing contact with each other by a specified pressure level from the corresponding pulleys 81 to 80 and from 91 to 90, respectively. Likewise, the belt 41 in the drive portion and the belt 42 in the driven portion are brought into pressing contact with each other by a specified pressure level from the corresponding pulleys 81 to 80 and from 91 to 90, respectively.

Further, the rotary shafts 81*a*, 91*a* rotatable together with the pulleys 81, 91 are provided with guide rollers 81*b*, 91*b* at an intermediate portion thereof, respectively. The rollers 81*b*, 91*b* have a specified length in the widthwise direction of the apparatus and are brought into pressing contact with each other at a specified pressure level. The rollers 81*b*, 91*b* are coaxially and rotatably supported about the rotary shafts 81*a*, 91*a*, respectively. When a printing sheet P is transported between the rollers 81*b*, 91*b*, a frictional force is caused between one side of the printing sheet P and an outer surface of the roller 81*b* and between the other side of the printing sheet P and an outer surface of the roller 91*b*. When the printing sheet P is transported downward between the rollers 81*b*, 91*b* along the sheet transport path by the belts 43, 44, the rollers 81*b*, 91*b* are rotated due to the frictional force.

When the drive shaft 804 is rotated in the clockwise direction in FIG. 4B, an intermediate portion of a printing sheet P fed to the printing arrangement 4 is nipped by the rollers 81*b*, 91*b*. At the same time, both front and rear ends of the printing sheet P are nipped by the belts 41 and 42 and 43, 44, respectively. Subsequently, the printing sheet P is transported downward from the pulleys 81, 91 to the pulleys 80, 90 in the state that the front and rear ends of the printing sheet P are continuously brought into sliding contact with the transport belts 41, 42 and 43, 44, respectively, while an intermediate portion of the printing sheet P is being continuously guided by the guide rollers 81*b*, 91*b*. Accordingly, the printing sheet P can be reliably transported along the sheet transport path.

A rotating amount and rotating speed of the drive pulley 80, namely, a transport distance and a transport speed of printing sheet are controlled by counting the number of drive pulses supplied to the belt driving motor 803.

Further, as shown in FIG. 4B, a portion of the transport belt 43 (41) stretched between the corresponding pulleys 81, 82 is tilted downward as approaching toward the corresponding pulley 81, while a portion of the transport belt 44 (42) stretched between the corresponding pulleys 91, 92 is tilted downward as approaching toward the corresponding pulley 91 to thereby make a substantially V-shape between these two portions. With this arrangement, after having been transported in the printing arrangement 4, front and rear ends of a printing sheet P can be reliably guided through front and rear apexes of the front and rear V-shaped portions defined by the transport belts 43, 44 and 41, 42 to thereby guide the printing sheet P through the printing arrangement 4 reliably.

Figure 5:
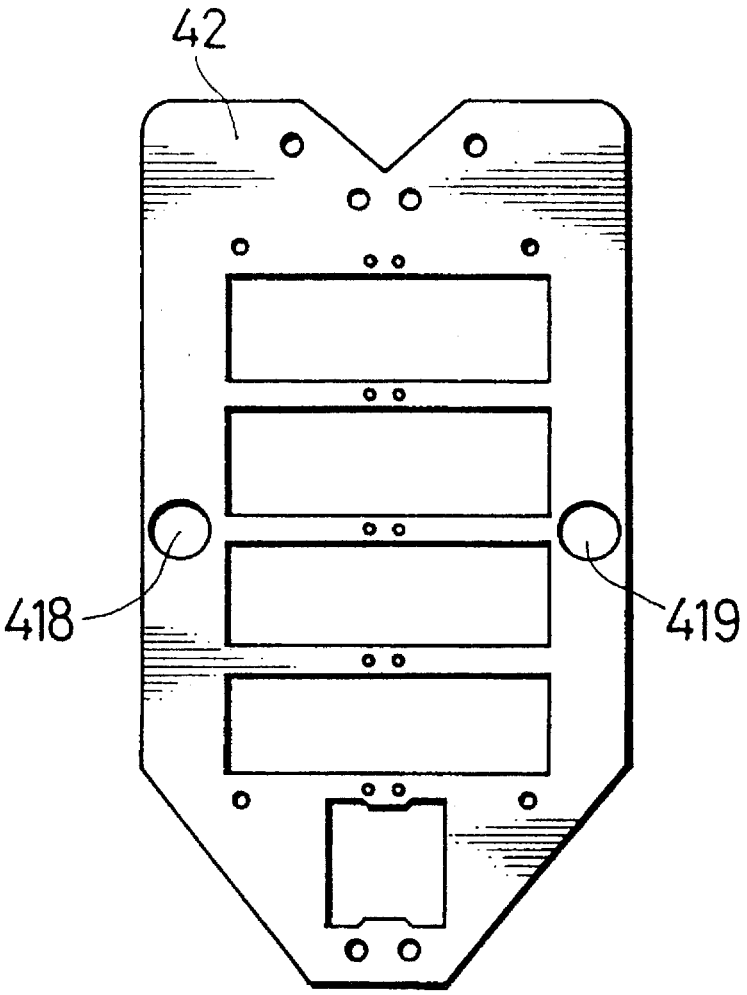
FIG. 5 is a front view showing a belt carriage.

Next, a belt carriage moving mechanism will be described with reference to FIGS. 4A to 5. The pair of movable belt carriages 39, 40 are provided parallel with the front and rear frame walls 11, 12. It should be appreciated that in this embodiment, the home position of the belt carriage 39 is near the rear frame wall 12, and the home position of the belt carriage 40 is near the front frame wall 11. The belt carriages 39, 40 are movable toward and away from each other in the widthwise direction of the apparatus. The movable belt carriages 39, 40 are adapted for selectively setting the position of the transport belts 41 to 44 in accordance with the size of printing sheets.

The movable belt carriage 39 is formed with holes through which the rotary shafts for rotatably supporting the pulleys 80 to 84, 90 to 94, and the idle rollers 85, 95 are to be passed. The belt carriage 39 has four hollows each having a substantially rectangular shape formed at a specified position on a central portion thereof so that the respective printing head units 5*a*. 5*b* are insertable through the hollows in the widthwise direction of the apparatus. The belt carriage 39 is further formed at a specified position on a lower portion thereof with a substantially rectangular hollow through which the dryers 10 are insertable in the widthwise direction of the apparatus. The belt carriage 39 is further formed with holes through which sleeves 421*a*, 422*a* are fixedly attached. The belt carriage 40 is identical to the belt carriage 39.

A slide shaft 422 which extends in the widthwise direction of the apparatus and is supported to the front and rear frame walls 11, 12 is fitted through the sleeves 422*a* of the movable belt carriages 39, 40. A ball shaft 421 which also extends in the widthwise direction of the apparatus and is rotatably supported to the front and rear frame walls 11, 12 is fitted through the sleeves 421*a* of the movable belt carriages 39, 40. Thus, the belt carriages 39, 40 are supported by the slide shaft 422 and the ball shaft 421.

The belt carriages 39, 40 are slidable on the slide shaft 422 by way of the sleeves 422*a*. The sleeves 421*a* are internally threaded, while the ball shaft 421 is externally threaded in a specified portion on front and rear ends thereof. Specifically, a substantially front half portion of the ball shaft 421 is threaded in a specified spiral direction, while a rear half portion is threaded in a direction opposite to the specified spiral direction to thereby change a rotating direction between the front and rear half portions. With this arrangement, when the ball shaft 421 is rotated in a clockwise direction in FIG. 4B, the belt carriages 39, 40 are moved toward each other in the widthwise direction of the apparatus. On the contrary, when the ball shaft 421 is rotated in a counterclockwise direction, the carriages 39, 40 are moved away from each other.

A gear wheel 423 fixedly secured to the ball shaft 421 meshes with a gear wheel 424 of a belt carriage motor 425. The belt carriage motor 425 is a stepping motor and adapted for rotating the ball shaft 421 by way of the gears 424, 423. By rotating the ball shaft 421 in a forward direction or in a reverse direction, the belt carriages 39, 40 are moved toward and away from each other in accordance with the sideways size of printing sheet. A rotating amount of the ball shaft 421, namely, a moving distance of the belt carriages 39, 40 is controlled by counting the number of drive pulses supplied to the belt carriage motor 425.

As shown in FIG. 3B, a right upper portion of the movable belt carriage 39 (40) is inclined at a specified angle with respect to the lengthwise direction of the apparatus, while a left upper portion of the belt carriage 39 (40) extends horizontally having a specified length. The right upper portion of the belt carriage 39(40) is formed with a projection 39*a* (40*a*) extending inward. The projection 39*a* (40*a*) is located on an upstream of the registration roller pair 38.

A sheet detector 30 is mounted on the projection 39*a* (40*a*). The sheet detector 30 is located above the driven transport belt 42 (44). The sheet detector 30 is a reflective photosensor including a light emission portion and a photodetecting portion. The light emission portion emits light onto a surface of a printing sheet and the light reflected from the surface is received by the photodetecting portion to turn the sheet detector on, thereby detecting the presence of sheet.

By moving the belt carriages 39, 40 toward and away from each other in the widthwise direction of the apparatus while suspending feeding of a printing sheet P at the registration roller pair 38, front and rear ends of the printing sheet P is detected by the sheet detectors 30. When the sheet detectors 30 detect the presence of the printing sheet P in the process of the belt carriages 39, 40 being toward each other, the moving of the belt carriages 39, 40 are stopped its movement and the transport belts 41 to 44 are placed in the state of nipping and transporting the printing sheet P.

Feeding of a printing sheet to the printing arrangement 4 will be described next. When a printing sheet P dispensed from a specified cassette is fed to the printing arrangement 4, the transport of the printing sheet P is temporarily suspended by the registration roller pair 38. Subsequently, the belt carriages 39, 40 are moved toward each other from the home position along the widthwise direction of the apparatus. In this time, the sheet detectors 30 on the projections 39*a*, 40*a* detect whether a printing sheet P exists. When the sheet detectors 30 detect front and rear ends of a printing sheet P, the driving of the belt carriages 39, 40 are stopped to thereby render the belts 41 to 44 nip the front and rear ends of the printing sheet P.

In this embodiment, when a printing sheet of A3 size is fed, the support belts 39, 40 are selectively moved to the position shown by the solid lines in FIG. 4A, and when a printing sheet of A4 size is fed, the belt carriages 39, 40 are selectively moved to the position shown by the dashed lines in FIG. 4A. When the belt carriages 39, 40 are selectively moved to the specified position in accordance with the widthwise size of printing sheet, the driving roller of the registration roller pair 38 starts rotating to transport the printing sheet P downward for printing.

When a plurality of printing sheets are fed one after another to perform printing of an image onto the printing sheets successively, printing is continued provided that the sheet detectors 30 are turned on in a state that the printing sheets after a first printing sheet P1 are stopped their transport one by one by the registration roller pair 38. Thus, printing can be performed onto the plurality of printing sheets at a high speed.

Further, when either one of the sheet detectors 30 is still in the OFF state, printing is suspended and the apparatus causes the display section to display a warning such as jamming of a sheet. It may be possible to move the belt carriages 39, 40 further toward each other to confirm whether any printing sheet does not exist.

It may be possible to stop not only driving of a registration roller drive motor 38*c* but also driving of the transport belt motor 803 to stop printing.

Further, it may be possible to move the belt carriages 39, 40 each time the registration roller pair 38 stops feeding of the printing sheets after a first sheet P1 has been transported in the printing arrangement 4. Specifically, in the case of a sheet detector being initially in the OFF state, the belt carriages 39, 40 are moved toward each other until the sheet detector 30 comes into the ON state. On the other hand, in the case of a sheet detector being initially in the OFF state, the belt carriages 39, 40 are moved away from each other and again moved toward each other until the sheet detector comes into the ON state. In this way, the sheet detectors 30 detect the presence of a printing sheet having the size larger than a reference sheet.

The belt carriages 39, 40 are moved toward and away from each other in accordance with printing sheets P. Accordingly, the pulleys 80 to 84, and 90 to 94 and transport belts 41 to 44 are integrally moved in the widthwise direction of the apparatus in accordance with printing sheets P.

The front and rear ends of the printing sheet P are detected by the sheet detectors 30 in the state that the feeding of the printing sheet P has been temporarily suspended by the registration roller pair 38, and the belt carriages 39, 40 are moved toward or away from each other, and are reliably nipped by the belts 43, 44 and 41, 42, respectively. Accordingly, various sizes of printing sheets can be reliably transported along a sheet transport path defined by the transport belts 41 to 44 in accordance with the widthwise size of printing sheet, while being nipped at the rear and front ends by the belts 41, 42 and 43, 44, respectively. Consequently, jamming of printing sheet in the printing arrangement 4 and clogging of nozzles in the printing head units 5*a*, 5*b* accompanied with the jamming of sheet can be assuredly prevented.

The driving transport belts 41, 43 and the driven transport belts 42, 44 are simultaneously moved toward and away from each other in the widthwise direction of the apparatus in accordance with an inputted size of printing sheet. However, either one of the driving transport belt 41 and the driven transport belt 42, or the driving transport belt 43 and the driven transport belt 44 may be made movable. In the case where the belts 41, 42 are made movable and the belts 43, 44 stay in a stationary posture, the belts 43, 44 may be moved outside the printing head units 5*a*, 5*b* only at an enclosing operation of nozzles by a capping portion or at a home position emission operation to be described later. Thus, the belts 43, 44 in the stationary posture can reduce its moving distance.

Next, the printing mechanism in the ink jet printing apparatus will be described with reference to FIGS. 4A and 4B. As shown in FIG. 4A, the printing head unit 5*a* has an elongated box-like shape extending in the widthwise direction of the apparatus. Likewise, the printing head unit 5*b* has an elongated box-like shape extending in the widthwise direction of the apparatus.

The printing head unit 5*a* includes a nozzle portion 51*a* and a capping portion 52*a*, and the printing head unit 5*b* includes a nozzle portion 51*b* and a capping portion 52*b*. As shown in FIG. 4B, the nozzle portion 51*a* is arranged above the capping portion 52*a*. On the contrary, the nozzle portion 51*b* is arranged below the capping portion 52*b*. Thus, the nozzle portion 51*a* opposes to the capping portion 52*b*, and the nozzle portion 51*b* opposes to the capping portion 52*a*. The printing head units 5*a*, 5*b* are moved toward and away from each other by a printing head unit moving mechanism to be described later, and selectively moved to a contact position where the printing head units 5*a*, 5*b* come into contact with each other or to a spaced-away position where the printing head units 5*a*, 5*b* are spaced away from each other by a specified distance.

Specifically, when a printing sheet P is not transported along the sheet transport path, the printing head units 5*a*, 5*b* are moved to the contact position. On the other hand, when a printing sheet P is transported along the sheet transport path, the printing head unit 5*a*, 5*b* are moved to the spaced-away position spaced away from each other by a specified distance, e.g., 2 mm.

The nozzle portions 51*a*, 51*b* each includes a large number of minute nozzles which are arranged in the form of matrix. Each nozzle is provided with a piezoelectric conversion element to control ink emission. Ink is emitted through each nozzle onto both side surfaces of a printing sheet P simultaneously by an ink emitter provided in each nozzle to thereby print images on the both side of the printing sheet P. In this embodiment, the length of the nozzle portion is made to have a length equal to the shorter side of the A3-sized printing sheet.

Through the nozzles in the printing head units 5*a*, 5*b* are emitted ink of yellow color (Y), ink of magenta color (M), ink of cyan color (C), and ink of black color (BK) in this order in the downward direction. These inks are superimposedly emitted onto a printing sheet P transported in the printing arrangement to thereby print a colored image on the printing sheet P.

It may be possible to adopt an arrangement of minute nozzles in a zigzag or in a line other than a matrix.

Further, it may be possible to provide only one pair of printing head units 5*a*, 5*b* to print a monochromatic image on a printing sheet P. e.g., a black monochromatic image.

The capping portion 52*a* (52*b*) is made of a rubber or a soft synthetic resin. When a printing is not instructed, the printing head units 5*a*. 5*b* are moved toward each other and brought into the contact state to thereby enclose the nozzles of the printing head unit 5*a* and the nozzles of the printing head unit 5*b* by the capping portion of the printing head unit 5*b* and the capping portion of the printing head unit 5*a*, respectively. This will prevent ink at a lead end of the nozzle from drying or solidifying, and foreign matters and bubbles from entering into the nozzle.

When the nozzles are enclosed by the capping portion, unillustrated absorptive means generates an absorptive force and is operated to reduce the ink pressure or give a pressure, to adjust meniscus of ink at the lead end of the nozzles, to draw the ink to eliminate foreign matters and bubbles and to maintain the specified emission conditions.

During a printing operation, transport of a printing sheet to the printing arrangement 4 is temporarily suspended at a specified interval, and the transport belts 41 to 44 are temporarily retracted from the nozzle portions 51*a*, 51*b* by the belt carriage moving mechanism. Subsequently, ink is forcibly emitted through all the nozzles to the capping portion 52*b*, 52*a* to prevent less frequently used nozzles from clogging. This ink emission is referred to as "home position emission". The home position emission may be performed either in the state of the capping portions 52*b*, 52*a* enclosing the nozzle portions 51*a*, 51*b* or in the state of the capping portions 52*b*, 52*a* not enclosing the nozzle portions 51*a*, 51*b*.

Figure 6B:
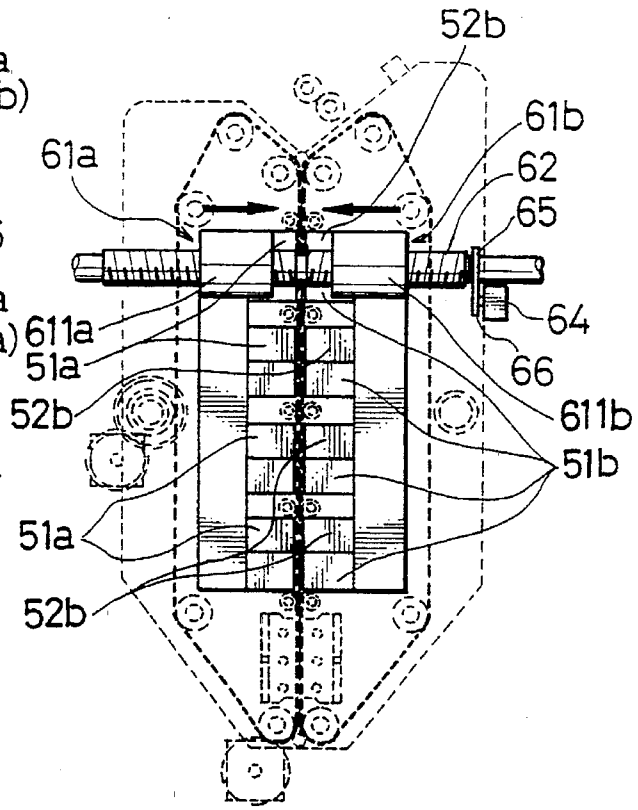
FIG. 6B is a front sectional view showing the printing head unit moving mechanism.

Next, the printing head unit moving mechanism for moving the printing head units 5*a*, 5*b* will be described with reference to FIGS. 3 and 6B.

The printing head unit moving mechanism includes a pair of front and rear support plates 61*a* and a pair of front and rear support plates 61*b* for supporting the printing head units 5*a* and 5*b*, respectively. The rear support plate 61*a* (61*b*) is connected to a rear wall of the printing head unit 5*a* (5*b*). and the front support plate 61*a* (61*b*) is connected to a front wall of the printing head unit 5*a* (5*b*).

The front and rear support plates 61*a* have support blocks 611*a*, 612*a* at an upper portion thereof, respectively. The support block 611*a* projects forward from the front frame wall 11 by a specified length in the widthwise direction of the apparatus, and the support block 612*a* projects rearward from the rear frame wall 12 by a specified length. The support blocks 611*a*, 612*a* are formed with through holes 62*a*, 63*a*, respectively. Likewise, the front and rear support plates 61*b* have support blocks 611*b* and 612*b* at an upper portion. The support block 611*b* projects forward from the front frame wall 11 by a specified length, and the support block 612*b* projects rearward from the rear frame wall 12 by a specified length. The support blocks 611*b*, 612*b* are formed with through holes 62*a*, 63*a*, respectively.

A slide shaft 63 extending in the lengthwise direction of the apparatus is supported on the main body of the ink jet printing apparatus, and is passed through the holes 63*a*. The support blocks 612*a*, 612*b* are slidable on the slide shaft 63.

Also, a ball shaft 62 extending in the lengthwise direction the apparatus is rotatably supported on the apparatus main body, and is passed through the holes 62*a*. The holes 62*a* are internally threaded. However, the thread direction of the hole 62*a* in the support block 611*a* is opposite to that of the hole 62*a* in the support block 611*b*. The ball shaft 62 is externally threaded in a specified portion on left and right ends thereof. Specifically, a substantially left half portion of the ball shaft 62 is threaded in a specified spiral direction, while a right half portion is threaded in a direction opposite to the specified spiral direction to thereby change a rotating direction between the left and right half portions. With this arrangement, when the ball shaft 62 is rotated in a clockwise direction in FIG. 6A, the front and rear support plates 61*a*, 61*b* are moved away from each other in the lengthwise direction of the apparatus, while being moved toward each other when the ball shaft 62 is rotated in a counterclockwise direction.

A gear wheel 65 is fixedly secured to the ball shaft 62. The gear wheel 65 is meshed with a gear wheel 66 connected to a head support plate motor 64. The head support plate motor 64 is a stepping motor and adapted for rotating the ball shaft 62 by way of the gear wheels 66, 65. A rotating amount of the ball shaft 62, i.e., a moving amount of the front and rear support plates 61*a*, 61*b* is controlled by counting the number of drive pulses supplied to the head support plate motor 64.

Next, movement of the printing head units 5*a*, 5*b* will be described.

Figure 6A:
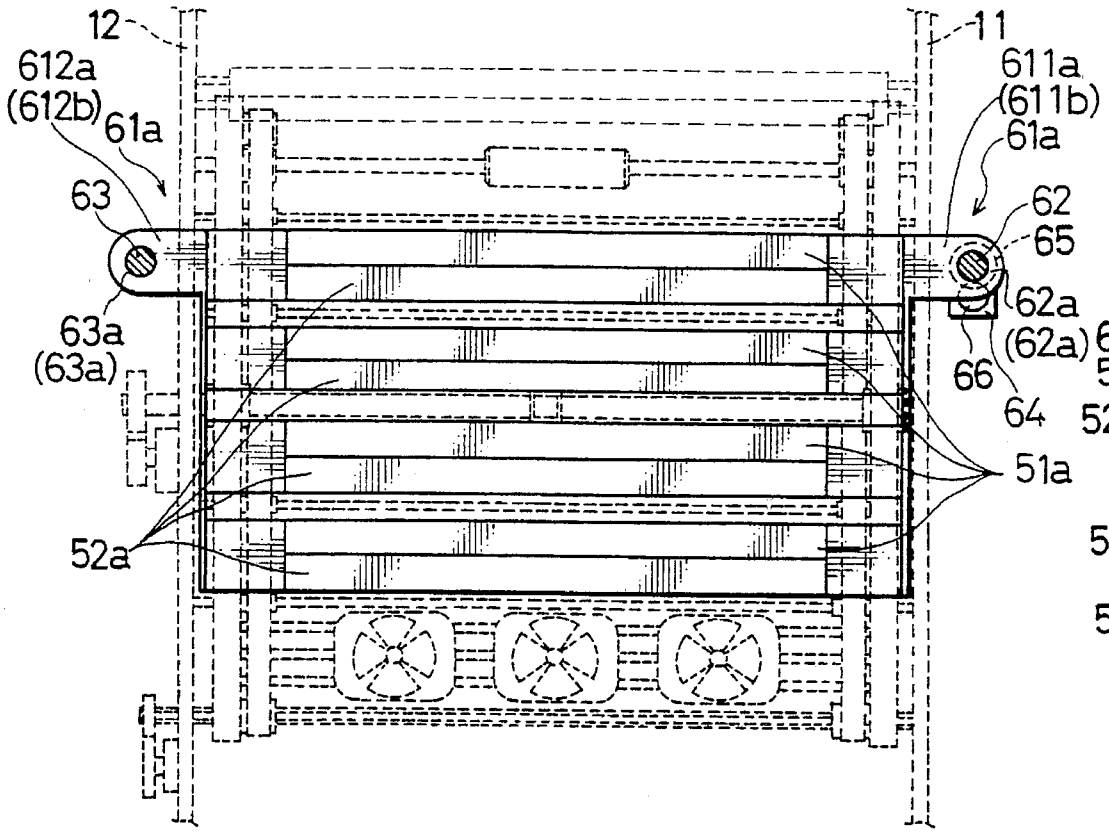
FIG. 6A is a left side sectional view showing the printing head unit moving mechanism.

When the printing operation is instructed, the ball shaft 62 is rotated in a clockwise direction in FIG. 6A to move the front and rear support plates 61*a*, 61*b* away from each other in the lengthwise direction of the apparatus, respectively. Consequently, the printing head units 5*a*, 5*b* are moved away from each other and brought into the spaced-away state to open the nozzle portions.

When the printing operation is finished, the ball shaft 421 is rotated in a counterclockwise direction in FIG. 3B to thereby move the belt carriages 39, 40 away from each other in the widthwise direction of the apparatus. Thereby, the transport belts 41 to 44 are moved outside the printing head units 5*a*, 5*b*, respectively. Subsequently, the ball shaft 62 is rotated in a counterclockwise direction in FIG. 6A to move the front and rear support plates 61*a*, 61*b* toward each other in the lengthwise direction of the apparatus. Thereby, the printing head units 5*a*, 5*b* are moved toward each other and brought into the contact state to close the nozzles by the capping portion.

In this way, the respective nozzle portions of the printing head units 5*a* and 5*b* are opened and closed by rotating the ball shaft 62 to move the support plates 61*a*, 61*b* toward and away from each other.

In this embodiment, the front and rear support plates 61*a*, 61*b* are simultaneously moved toward and away from each other. However, only one group of support plates may be moved toward and away from the other group of support plates which is held stationary to allow one printing head unit to move toward and away from the other printing head unit. In this case, the nozzles of one printing head unit can be closed or opened by the capping portion of the other printing head unit.

A structure of the dryer 10 will be described next with reference to FIGS. 3A and 3B. The dryer 10 is provided both on the drive portion and the driven portion of the printing sheet transport mechanism. Specifically, the dryers 10 are arranged in the printing arrangement 4 on a downstream end with respect to the sheet transport direction, respectively. The dryers 10 oppose to each other along the sheet transport path. The dryers 10 each include a plurality of fans 101 and heaters 102. As shown in FIG. 3A, for example, the three fans 101 in the drive portion are arranged side by side in the widthwise direction of the apparatus by a specified distance to send heated air toward one side of a printing sheet P having an ink image printed thereon to dry the ink. Likewise, three fans 101 in the driven portion are arranged side by side to send heated air toward the other side of the printing sheet P. The heater 102 has a heat source such as a halogen lamp and a heating (nichrome) wire and extends in the widthwise direction of the apparatus having a length substantially identical to the length of the printing head units 5*a*, 5*b*. The heaters 102 of the respective dryers 10 are arranged parallel with one another by a specified distance in the sheet transport direction and interposed between the sheet transport path and the fans 101. With this arrangement, air heated by the heaters 102 is blown out by the fans 101 toward both sides of a printing sheet P to dry ink on a printed image of the both sides.

Next, a control system of the ink jet printing apparatus will be described with reference to a block diagram in FIG. 7.

The ink jet printing apparatus is communicated with the image generator such as a personal computer, and operates in accordance with an operation signal and an image signal sent from the image generator.

The control system of the ink jet printing apparatus is provided with a controller 110 including a microcomputer. The controller 110 is internally provided with a CPU (Central Processing Unit) 120, a memory unit 111 and an interface portion 112. The CPU 120 controls an overall operation of the apparatus in timed relation with a clock signal. The CPU 120 has an ink emission control portion 121, a movement control portion 122, and a display control portion 123. The emission control portion 121 and the movement control portion 122 mutually and synchronously control various operations of the ink jet printing apparatus. The memory unit 111 includes an ROM (Read Only Memory) for storing a control program and an RAM (Random Access Memory) for temporarily storing image data.

An image signal generated from the image generator is received by the interface portion 112, and then sent to the ink emission control portion 121. The operation signal indicative of a sheet size and the like is also received by the interface portion 112 and sent to the movement control portion 122.

The movement control portion 122 sends a control signal to a drive circuit 114 which in turn drives the printing sheet transport assembly 13 to transport a printing sheet P from a specified cassette. The movement control portion 122 further controls driving of the sorter 8 every time an image printing is finished onto a printing sheet or a plurality of printing sheets. When sorting is not designated, the printing sheet(s) having been finished with the image printing is (are)

stacked in an uppermost tray, while being sorted out and placed onto the plurality of bin trays 8*a* one by one when sorting is designated. At the same time, the movement control portion 122 sends a control signal to the drive circuit 114 which in turn sends drive pulses to the belt driving motor 803, belt carriage motor 425, head support plate motor 64. The drive circuit 114 includes power and a transistor. The drive circuit 114 supplies an electric current to the respective motors for driving based on a control signal sent from the movement control portion 122.

The movement control portion 122 controls the widthwise movement of the belt carriages 39, 40 based on a resultant signal which is sent from the sheet detectors 30 during a predetermined period of the registration roller pair 38 temporarily suspending the feeding of a printing sheet being transported to the printing arrangement 4. The movement control portion 122 outputs a timing signal indicative of ink emission to the emission control portion 121 based on the number of drive pulses supplied to the belt driving motor 803 and on a discrimination result of whether or not a predetermined period of time has elapsed from the timing at which the registration roller pair 38 starts its driving. The movement control portion 122 further controllably discriminates whether or not front and rear ends of a printing sheet being transported along the transport path go out of the belts 41 to 44. The movement control portion 122 keeps activating the fans 101 and the heaters 102 for a time period from a timing at which an ink emission starts on a first printing sheet P1 to a timing at which a last printing sheet Pn has left the transport belts 41 to 44. It may be possible to arrange sheet detectors such as reflective photosensors immediately below the pulleys 80 to detect the leaving of a printing sheet from the belts 41 to 44.

An image signal generated from the image generator is received by the ink emission control portion 121, which in turn sends the image signal serially to driving circuits 113*a*, 113*b* arranged at an appropriate position in the printing head units 5*a*, 5*b*, respectively. The image signal is a serial signal in the form of one bit or a plurality of bits, e.g. eight bits. The driving circuits 113*a*, 113*b* each include a latch portion. The driving circuits 113*a*, 113*b* receive, temporarily latch the image signal, then convert the latched serial signal to parallel signals, and send the parallel signals to the piezoelectric conversion elements provided in the nozzles in the nozzle portions 51*a*, 51*b* in synchronism with one another.

The ink emission control portion 121 outputs the parallel signals sent from the driving circuits 113, 113*b* as a pulse drive signal to the piezoelectric conversion elements in the nozzles in synchronism with the operation of the movement control portion 122, to thereby control the ink emission. More specifically, each nozzle has an ink reservoir whose wall is partially defined by the piezoelectric conversion element. The piezoelectric conversion element is strained by applied voltage to increase the internal pressure of ink in the reservoir to emit the ink out of the nozzle. For example, in the case of receiving the image signal in the form of one bit, the driving circuits 113*a*, 113*b* send a parallel drive signal having the two states of "on" and "off" to the piezoelectric conversion element of the corresponding nozzle. In the "on" state, the piezoelectric conversion element is applied with a specified level of voltage to increase the pressure of the reservoir, so that a stream of ink forcibly spouts onto both sides of the printing sheet P out of the nozzle. In this way, one line of an image is printed each time the image signal corresponding to the line is sent to the driving circuits 113*a*, 113*b*. These one-line printings are successively repeated to complete the whole image printing.

A cyclic period of ink emission, namely, an interval between outputting parallel signals to the piezoelectric conversion elements to print one line of image and to print a next one line of image, primarily depends on the capability of the printing head units 5*a*, 5*b*. The transport speed of printing sheet during a printing operation, namely, rotating speed of the transport belt motor 803 is set in accordance with the cyclic period of ink emission.

The display control portion 123 receives detection signals indicative of a remaining ink amount of an ink cartridge, the absence of printing sheet in each cassette and the like, and causes the detection results to be displayed on the display section 1*b*. The display portion 123 also causes the display section 1*b* to display a warning that a sheet is jammed in the case where the sheet detectors 30 do not detect front and rear ends of the printing sheet P being transported in the printing arrangement 4 in a predetermined time period.

Figure 8B:
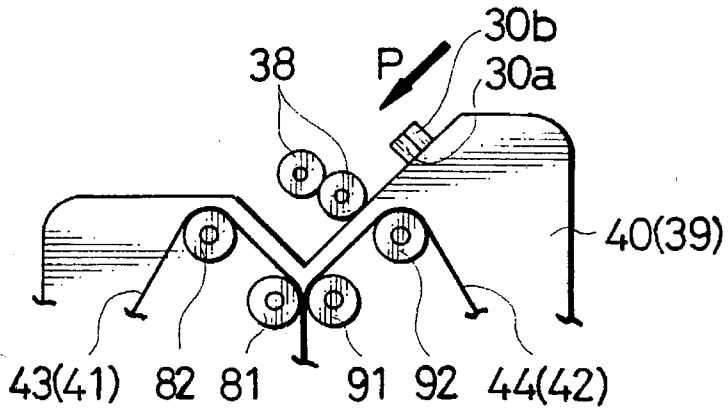
FIG. 8B is a front side view of the first sheet detecting arrangement.
Figure 8A:
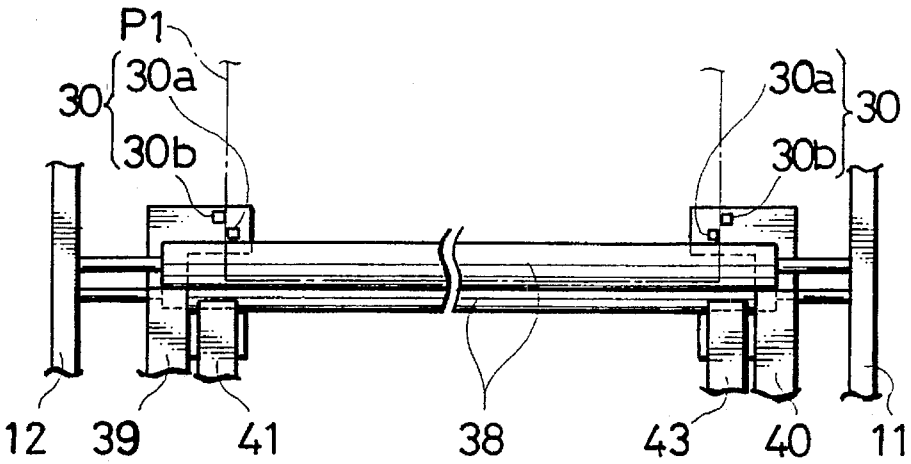
FIG. 8A is a left side view of a first sheet detecting arrangement of a pair of registration rollers and sheet detectors.

Next, a first sheet detecting arrangement of the ink jet printing apparatus will be described with reference to FIGS. 8A and 8B. FIG. 8A is its left side view while FIG. 8B is its front view.

The sheet detector 30 provided at an appropriate position of the projection 39*a* (40*a*) of the belt carriage 39 (40) includes a first sheet sensing portion 30*a* and a second sheet sensing portion 30*b*. The first sheet sensing portion 30*a* is located at a downstream side of the projection 39*a* (40*a*) while the second sheet sensing portion 30*b* is located at an upstream side of the projection 39*a* (40*a*). Also, the first sheet sensing portion 30*a* is located inner than the second sheet sensing portion 30*b*.

The first sheet sensing portion 30*a* in the projection 39*a* corresponds to the first sheet sensing portion 30*a* in the projection 40*a*. and the second sheet sensing portion 30*b* in the projection 39*a* corresponds to the second sheet sensing portion 30*b* in the projection 40*a*. When the first sheet sensing portions 30*a* are turned on and the second sheet sensing portions 30*b* are turned off, it is detected that a printing sheet P has its front and rear ends in the widthwise direction nipped by the belts 43, 44 and 41, 42 in a suitable manner, respectively.

Feeding of a printing sheet P to the printing arrangement 4 will be described next. When a printing sheet P dispensed from a specified cassette is fed to the printing arrangement 4, the transport of the printing sheet P is temporarily suspended by the registration roller pair 38. Subsequently, the belt carriages 39, 40 are selectively moved toward each other from the home position along the widthwise direction of the apparatus in accordance with the sheet size designated by the image generator, and it is verified that both of the first sheet sensing portions 30*a* are turned on and both of the second sheet sensing portions 30*b* are turned off. After the verification, the driving roller of the registration roller pair 38 starts rotating to transport the printing sheet P downward in the printing arrangement 4.

When a plurality of printing sheets are fed one after another to print an image onto the printing sheets successively, printing is continued provided that both of the first sheet sensing portions 30*a* are turned on and both of the second sheet sensing portions 30*b* are turned off in the state that the printing sheets coming after a first printing sheet P1 are suspended their transport one by one by the registration roller pair 38.

Further, when either one of the first sheet sensing portions 30*a* is turned off, printing is suspended and the belt carriages 39, 40 are moved toward each other until the first sheet sensing portion 30*a* in the OFF state is turned on. On the other hand, when either one of the second sheet sensing portions 30*b* is turned on, printing is suspended, and the belt carriages 39, 40 are moved away from each other until the second sheet sensing portion 30*b* in the ON state is turned off. Then, the printing is carried on.

Thus, the provision of the two sheet sensing portions in a sheet detector makes it easier to detect the presence or absence of a front or rear end of a printing sheet. In addition, the time required for moving the belt carriages 39, 40 for detection of front and rear ends of a next printing sheet P2 is reduced, thereby reducing the time necessary for printing as a whole.

In the case where it is necessary to move the belt carriages 39, 40 after the first printing sheet P1 has been transported, it may be possible to cause the display section 1*b* to display a jamming of a sheet to stop the printing operation. Further, it may be possible to enhance the detecting accuracy of the sheet detector by locating the first and second sheet sensing portions 30*a* and 30*b* closer to each other.

Figure 9B:
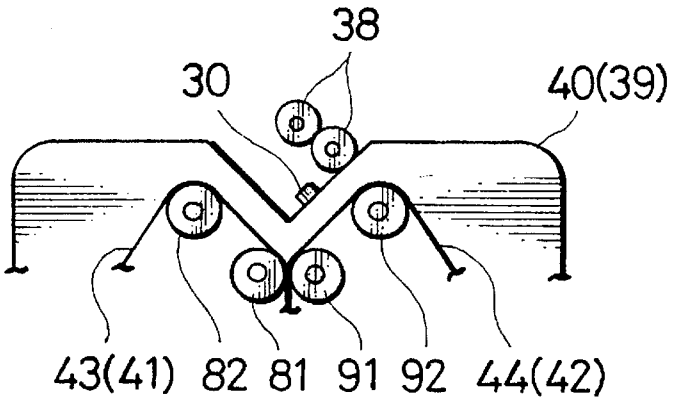
FIG. 9B is a front side view of the second sheet detecting arrangement.
Figure 9A:
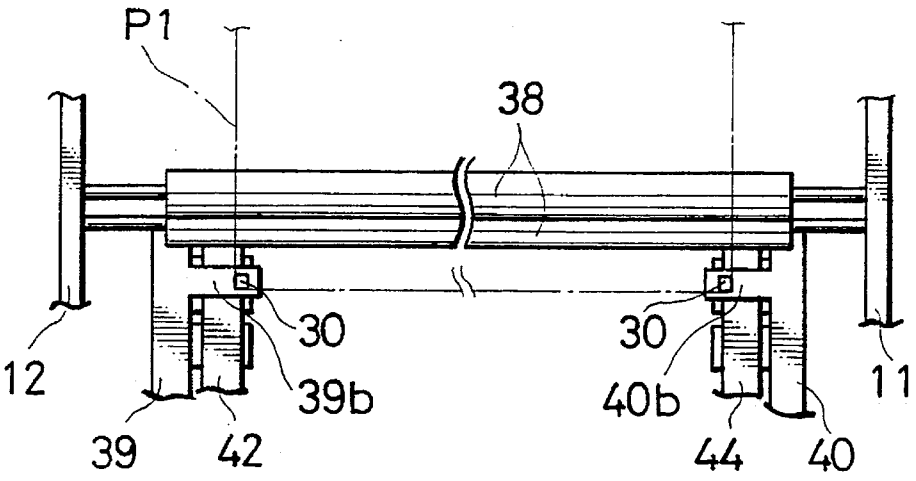
FIG. 9A is a left side view of a second sheet detecting arrangement of a pair of registration rollers and sheet detectors.

Next, a second sheet detecting arrangement will be described with reference to FIGS. 9A and 9B. FIG. 9A is its view left side while FIG. 9B is its front view.

In this sheet detecting arrangement, a right upper portion of the movable belt carriage 39 (40) is on the same horizontal plane as a left upper portion of the belt carriage 39 (40). The right upper portion of the belt carriage 39 (40) is formed with a projection 39*b* (40*b*) on a downstream of the registration roller pair 38. Similarly to the projections 39*a* (40*a*), the projection 39*b* (40*b*) extends inward by a specified length. The sheet detectors 30 are mounted on the projections 39*b*, 40*b* above the driven transport belts 42, 44, respectively. The sheet detectors 30 are arranged at an appropriate position of the projections 39*b*, 40*b* so as to detect front and rear ends a printing sheet P when the printing sheet P is transported in the printing arrangement 4 by the registration roller pair 38. The movement control portion 122 is provided with a timer which measures a period from a time at which the registration roller pair 38 starts rotating to a time at which the sheet detectors 30 in the projections 39*b*, 40*b* are turned on.

Feeding of a printing sheet P to the printing arrangement 4 will be described. A printing sheet P dispensed from a specified cassette is temporarily suspended its feeding by the registration roller pair 38 in the state that a lead end of the printing sheet P is nipped between the driving roller and the driven roller of the registration roller pair 38. Subsequently, the belt carriages 39, 40 are selectively moved toward each other from the home position along the widthwise direction of the apparatus in accordance with the sheet size designated by the image generator. Then, the registration roller pair 38 starts rotating to transport the printing sheet P in the printing arrangement 4 to print an image on the printing sheet P.

When both of the detectors 30 are turned on in a predetermined time period from the driving of the registration roller pair 38, the printing is continued. On the contrary, when either one of the sheet detectors 30 is not turned on in the predetermined time period, it is judged that the printing sheet P is transported obliquely. Accordingly, the display control portion 123 causes the display section 1*b* to display a jamming of sheet, thereby stopping the printing. Further, a time period for turning one of the sheet detectors 30 on and for turning the other of the sheet detectors 30 on after the driving of the registration roller pair 38 is measured to obtain a time difference between the two time periods. When the time difference is not smaller than a predetermined value, it is judged that the printing sheet P is transported obliquely. Consequently, the display control portion 123 causes the display section 1*b* to display jamming of sheet to stop the printing.

The sheet detectors 30 are disposed immediately above the pulleys 91 to detect the presence of front and rear ends of a printing sheet being transported to the printing arrangement 4 by the registration roller pair 38. Further, a period of time is measured from the driving of the registration roller pair 38 to the detection of the front and rear ends of the printing sheet by the sheet detectors 30, and a e time difference is calculated between the timing at which the one of the sheet detectors 30 is turned on and the timing at which the other of the sheet detectors 30 is turned on. When the time difference is not smaller than the predetermined value, it is detected that a skew transport of printing sheet has occurred. Hence, the printing operation is stopped, and the printing sheet is prevented from going out of the transport path defined by the belts 41 to 44.

Figure 10B:
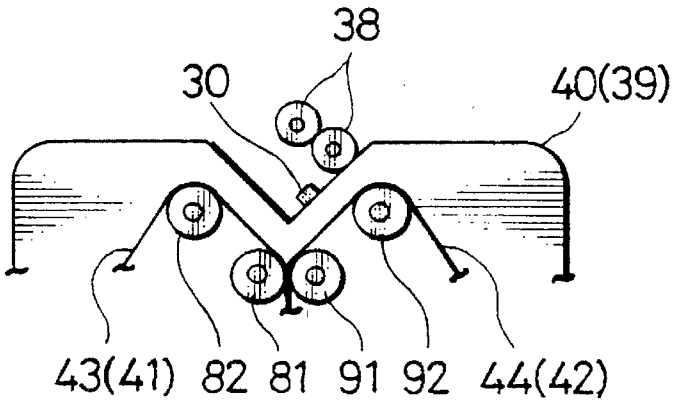
FIG. 10B is a front side view of the third sheet detecting arrangement.
Figure 10A:
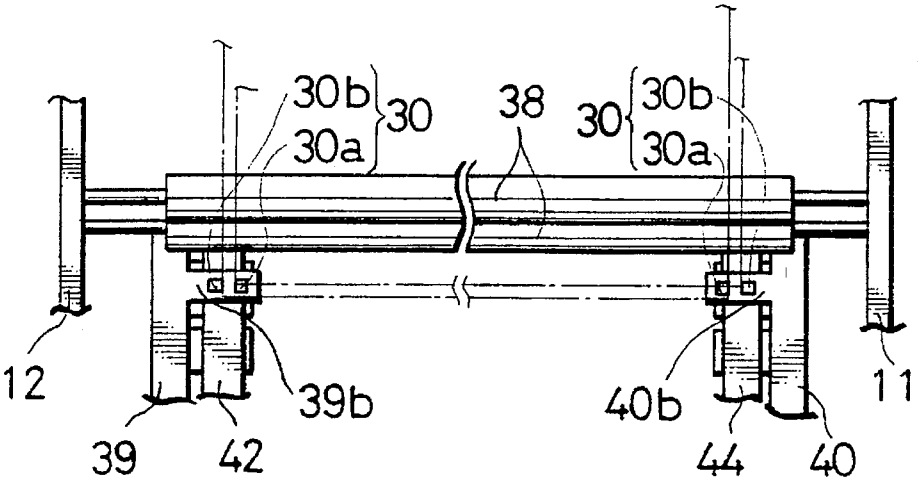
FIG. 10A is a left side view of a third sheet detecting arrangement of a pair of registration rollers and sheet detectors.

Next, a third sheet detecting arrangement will be described with reference to FIGS. 10A and 10B. FIG. 10A is its left side view while FIG. 10B is its front view.

In similar to the second sheet detecting arrangement, a right upper portion of the movable belt carriage 39 (40) is on the same horizontal plane as a left upper portion of the belt carriage 39 (40). In similar to the first sheet detecting arrangement, also, a sheet detector 30 is provided at an appropriate position of the projection 39*b* (40*b*) of the belt carriage 39 (40), and includes a first sheet sensing portion 30*a* and a second sheet sensing portion 30*b*. However, the first sheet sensing portion 30*a* and the second sheet sensing portion 30*b* are disposed on the same widthwise line at a specified spacing. The first sheet sensing portion 30*a* on the projection 39*b* corresponds to the first sheet sensing portion 30*a* on the projection 40*b*, and the second sheet sensing portion 30*b* on the projection 39*b* corresponds to the second sheet sensing portion 30*b* on the projection 40*b*. When the first sheet sensing portions 30*a* are turned on and the second sheet sensing portions 30*b* are turned off, it is detected that a printing sheet P has its front and rear ends in the widthwise direction nipped by the belts 43, 44 and 41, 42 in a suitable manner, respectively. The movement control portion 122 is provided with a timer which measures a period from a time at which the registration roller pair 38 starts rotating to a time at which the first sheet sensing portions 30*a* in the projections 39*b*, 40*b* are turned on.

Feeding of a printing sheet to the printing arrangement 4 will be described next. When printing sheet P dispensed from a specified cassette is fed to the printing arrangement 4, the transport of the printing sheet P is temporarily suspended by the registration roller pair 38. Subsequently, the belt carriages 39, 40 are selectively moved toward each other from the home position along the widthwise direction of the apparatus in accordance with the sheet size designated by the image generator. Then, the driving roller of the registration roller pair 38 starts rotating to transport the printing sheet P downward in the printing arrangement 4 to print an image on the printing sheet P.

When both of the first sheet sensing portions 30*a* are turned on in a predetermined time period and both of the second sheet sensing portions 30*b* are kept in an OFF state, the printing is carried on. On the contrary, when one of the first sheet sensing portions 30*a* is not turned on in the predetermined time period and either one of the second sheet sensing portions 30*b* is turned on, it is judged that the printing sheet P is transported obliquely. Accordingly, the display control portion 123 causes the display section 1*b* to display jamming of sheet to stop the printing.

Further, a time period for turning one of the first sheet sensing portions 30*a* on and a time period for turning the other of the first sheet sensing portions 30*a* on after the driving of the registration roller pair 38 is measured to obtain a time difference between the two time periods. When the time difference is not smaller than a predetermined value, it is judged that the printing sheet P is transported obliquely. Consequently, the display control portion 123 causes the display section 1*b* to display jamming of sheet to stop the printing.

The first and second sheet sensing portions are disposed on the same widthwise line. The sheet detectors are disposed immediately above the pulleys 91 to detect front and rear ends of a printing sheet which is being transported in the printing arrangement 4 by the registration roller pair 38. Accordingly, the sheet detectors 30 can detect the presence of a printing sheet having the size larger than the designated one, if such printing sheet has been fed to the printing arrangement 4. Further, obtained is a time difference between times at which the first sheet sensing portions 30*a* in the projections 39*b*, 40*b* are turned on. When a time difference is not smaller than the predetermined value, it is detected that a skew transport of the printing sheet has occurred. Hence, the printing operation is stopped, and the printing sheet is prevented from going out of the transport path defined by the belts 41 to 44.

A permissible area for transport of a sheet is set in such a manner that the first and second sheet sensing portions 30*a* and 30*b* are arranged at an appropriate position spaced apart from each other having the specified distance which is defined by the two phantom lines in FIG. 10A. Specifically, when a printing sheet is transported in the printing arrangement 4 in the state that the first sheet sensing portions 30*a* are in the ON state and the second sheet sensing portions 30*b* are in the OFF state, it is judged that front and rear ends of the printing sheet is nipped by the belts 41 to 44, and the printing is continued.

Figure 11B:
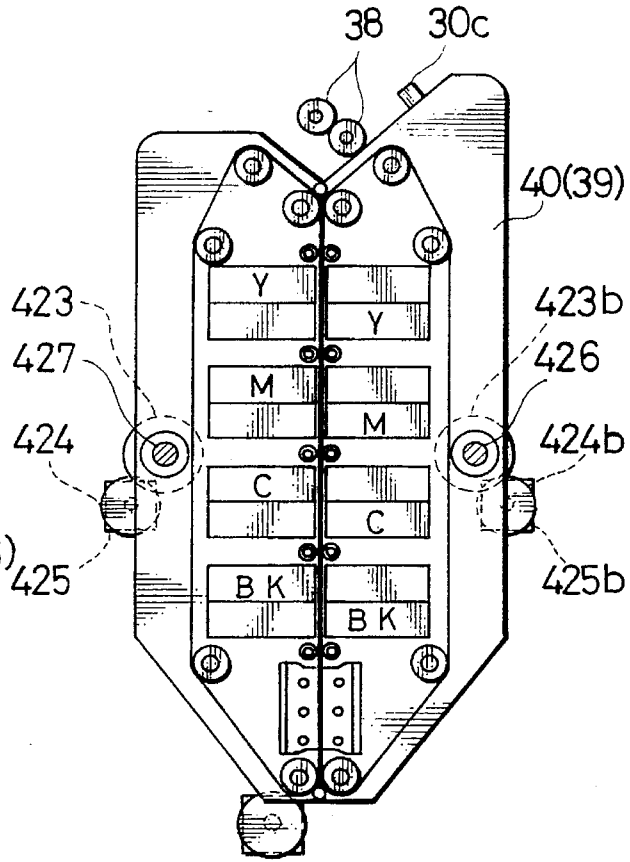
FIG. 11B is a front sectional view showing the second printing arrangement.
Figure 11A:
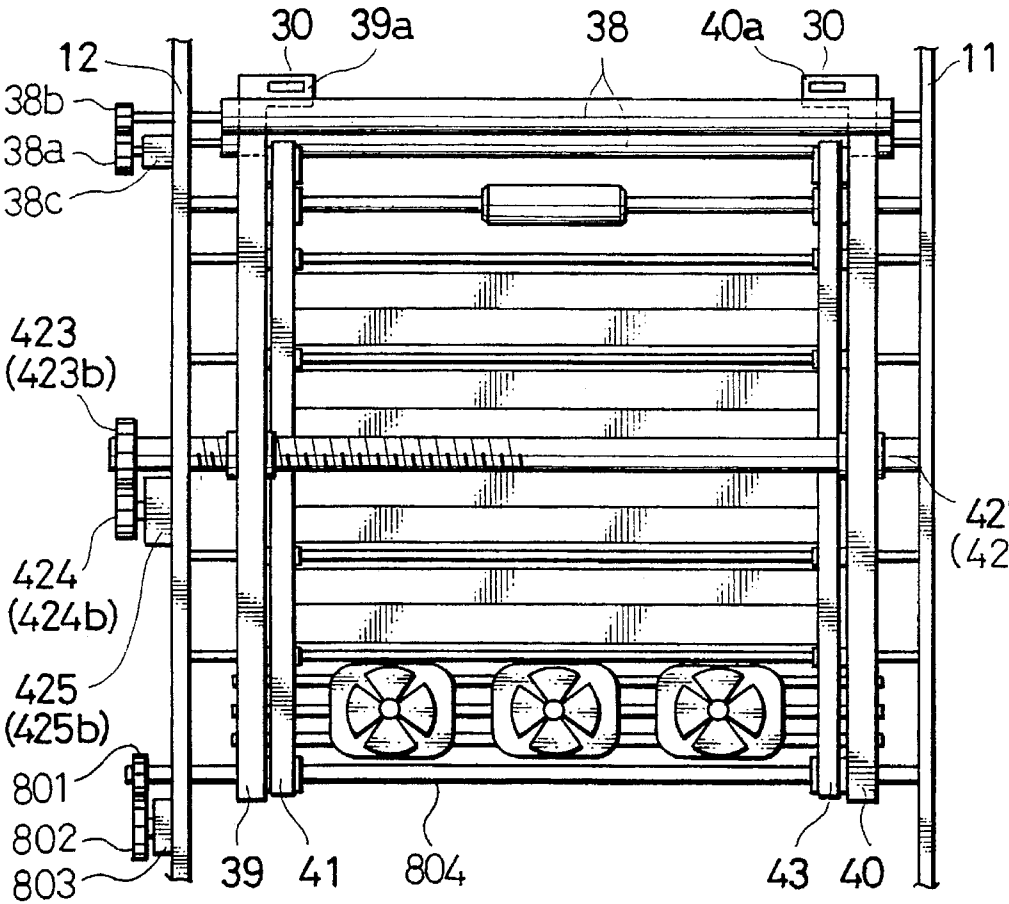
FIG. 11A is a left side sectional view showing a second printing arrangement.
Figure 12:
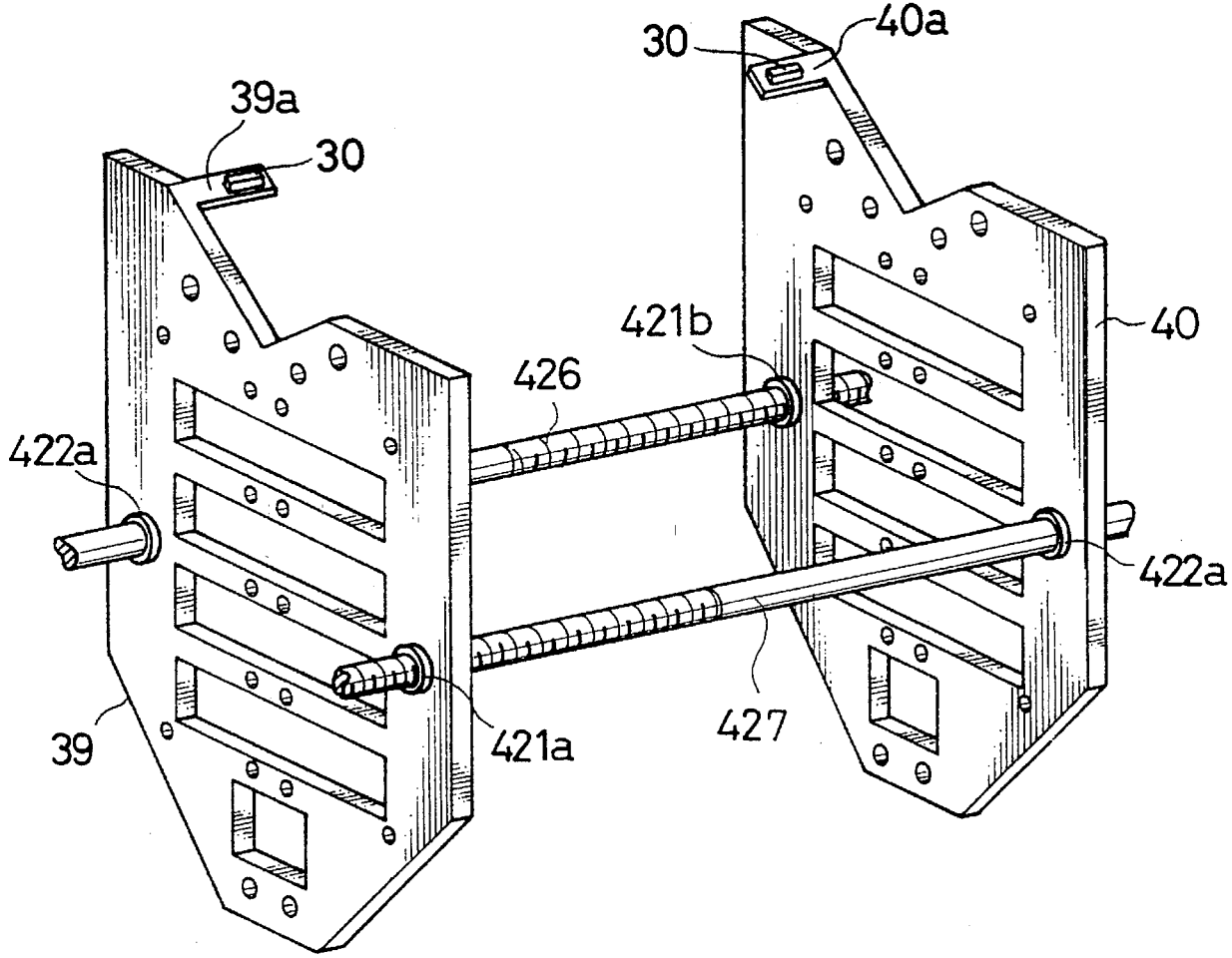
FIG. 12 is a perspective view showing a belt carriage moving mechanism of the second printing arrangement.

Next, a second printing arrangement for the ink jet printing apparatus will be described with reference to FIGS. 11A to 12. It should be appreciated that elements identical to those in the foregoing printing arrangement will be shown at the same reference numerals. FIG. 11A is a left side view of the second printing arrangement, and FIG. 11B is a front side view of the second printing arrangement. FIG. 12 is a perspective view showing a belt carriage moving mechanism for moving belt carriages 39, 40.

In this printing arrangement, sheet detectors 30 are disposed at an appropriate position above a registration roller pair 38. The belt carriages 39, 40 are made movable independently of each other. The sheet detectors 30 detect the presence of front and rear ends of a printing sheet P whose feeding is temporarily suspended by the registration roller pair 38 respectively, and output a detection result. The belt carriages 39, 40 are moved in widthwise directions of the apparatus independently of each other in accordance with the detection result.

The sheet detector 30 has a specified length extending in the widthwise direction of the apparatus and is mounted on a projection 39*a* (40*a*) of the movable belt carriage 39 (40). The sheet detector 30 is provided with a plurality of light emitting portions and photodetecting portions in pairs. Specifically, the pairs of very small light emitting portions and photodetecting portions are arranged in an array in a widthwise direction of the apparatus, i.e., widthwise direction of the printing sheet P, having a small interval between pairs. The light emitting portion and the photodetecting portion of each pair is arranged in a lengthwise direction of the apparatus, i.e., a transport direction of the printing sheet P. With this arrangement, front and rear end edges of the printing sheet P whose feeding is temporarily suspended by the registration roller pair 38 are detected by the photodetecting portions which are arrayed in the widthwise direction of the sheet P at a small interval. Accordingly, the front and rear ends of the printing sheet P can be detected at a high accuracy.

The belt carriages 39, 40 are independently movably supported by ball shafts 426, 427 instead of being supported by the slide shaft 422 and the ball shaft 421 in the foregoing arrangement. The belt carriage 39 is formed with through holes in which sleeves 421*a*, 422*a* are fixedly attached. The belt carriage 40 is formed with through holes in which sleeves 421*b*, 422*a* are fixedly attached. The ball shaft 426 which extends in the widthwise direction of the apparatus is placed in the sleeve 422*a* of the belt carriage 39 and the sleeve 421*b* of the belt carriage 40. The ball shaft 427 which also extends in the widthwise direction of the apparatus is placed in the sleeve 421*a* of the belt carriage 39 and the sleeve 422*a* of the belt carriage 40. Thus, the belt carriages 39, 40 are supported by the ball shafts 426 and 427.

The sleeve 421*a* of the belt carriage 39 and the sleeve 421*b* of the belt carriage 40 are internally threaded, while the ball shafts 426, 427 are externally threaded in a specified portion on front or rear ends thereof. Specifically, a front half portion of the ball shaft 426 is threaded in a specified spiral direction, while a rear half portion of the ball shaft 427 is threaded in a direction opposite to the specified spiral direction of the ball shaft 426. The belt carriages 39, 40 are slidably movable on the ball shafts 426, 427 by way of the sleeves 422*a* of the belt carriages 39, 40.

The ball shaft 427 is rotated by way of gears 424, 423 driven by a belt carriage motor 425 which is a stepping motor. Likewise, the ball shaft 426 is rotated by way of gears 424*b*, 423*b* driven by a belt carriage motor 425*b*.

When the ball shaft 427 is rotated in a forward or reverse direction, the belt carriage 39 is moved toward and away from the belt carriage 40. On the other hand, when the ball shaft 426 is rotated in a forward or reverse direction, the belt carriage 40 is moved toward and away from the belt carriage 39. Thus, the ball shafts 426, 427 are independently movable of each other widthwise directions of the apparatus. A rotating amount of the ball shafts 426, 427, namely, a moving distance of the belt carriages 39, 40 is controlled by the number of drive pulses supplied to the belt carriage motors 425, 425*b*.

An ink emission control portion 121 is capable of shifting an ink emission signal to be outputted to nozzle portions 51*a*, 51*b* nozzle by nozzle in the sideways direction of a printing sheet, i.e., in the widthwise direction of the apparatus based on data relating to the position of front and rear ends of a printing sheet which is detected by the sheet detectors 30. The belt carriage motor 425*b* as well as the belt carriage motor 425 is controlled by a movement control portion 122 by way of a drive circuit 114.

A feeding of a printing sheet to the printing arrangement 4 will be described. When a printing sheet P dispensed from a specified cassette is fed to the printing arrangement 4, the transport of the printing sheet P is temporarily suspended by the registration roller pair 38. Subsequently, the belt carriages 39, 40 are selectively moved toward each other independently of each other in accordance with the sheet size designated by the image generator. Upon the sheet detectors 30 detecting front and rear ends of the printing sheet the widthwise movement of the belt carriages 39, 40 is stopped so that the belts 41 to 44 can nip the front and rear ends of the printing sheet P in a suitable manner. Subsequently, the driving roller of the registration roller pair 38 starts rotating to transport the printing sheet P downward in the printing arrangement 4 to print an image on the printing sheet P. In this state, the ink emission signal is shifted nozzle by nozzle in the sideways direction of the printing sheet P to render the nozzle portions 51*a*, 51*b* emit ink onto a designated area of the printing sheet P in accordance with data relating to the position of the front and rear ends of the printing sheet P which is detected by the sheet detectors 30.

In the case where an image printing is executed onto a plurality of sheets, the above procedure to be performed with respect to a first printing sheet P1 is repeated to a second printing sheet P2 and the printing sheets thereafter. When it is detected that the position of front and rear ends of the second printing sheet P2 and the sheets thereafter is substantially identical to the first printing sheet P1, it may be possible to merely shift an ink emission signal based on a detection data on the position.

When the size of printing sheet detected by the sheet detectors 30 is not identical to the sheet size inputted from an image generator, it may be possible to magnify or reduce the image size in accordance with the magnification/reduction ratio of the sheet size to thereby print the magnified/reduced image onto the printing sheet. Further, it may be possible to discharge the print sheet out of the apparatus without printing an image thereon and to cause the display section 1*b* to display that the printing sheet of non-designated size has been fed.

It may be possible to provide the foregoing printing arrangement with the sheet detectors having an elongated shape. In this case, the position at which an image is to be printed can be adjusted by shifting an ink emission signal to be outputted to the nozzle portions 51*a*, 51*b* nozzle by nozzle.

Further, it may be possible to provide the second printing arrangement with the first sheet detectors. In this case, the sheet detector includes first and second sheet sensing portions arranged close to each other by a specified distance.

Further, the sheet detectors may be made movable toward and away from each other simultaneously according to the widthwise movement of the belt carriages 39, 40 during a time period when the printing sheet has its feeding temporarily suspended by the registration roller pair 38. In this case, front and rear ends of the printing sheet can be detected with a high accuracy, resulting in the same advantage as obtained by the sheet detectors having an elongated shape.

Further, the present invention is not limited to an ink jet printing apparatus capable of printing images on both sides of a printing sheet. The present invention is applicable to an apparatus capable of printing an image on only one side of a printing sheet, as long as such apparatus is provided with a sheet transport device in which a printing sheet can be transported along a transport path defined by transport belts in a state that both side ends in the sideways direction thereof can be nipped between the transport belts.

Although the present invention has been fully described by way of example with reference to the accompanying drawings, it is to be understood that various changes and modifications will be apparent to those skilled in the art. Therefore, unless otherwise such change and modifications depart from the scope of the invention, they should be construed as being included therein.

What is claimed is:

1. A sheet transporting device for use in an image forming apparatus, the sheet transport device comprising:

a first and second sheet transporting members disposed at a predetermined spacing in a widthwise direction of a sheet to be transported, the first sheet transporting member for transporting the sheet in a lengthwise direction of the sheet in contact with one side end portion of the sheet, the second sheet transporting member for transporting the sheet in the lengthwise direction in contact with the other side end portion of the sheet;

a sheet feeder provided at an upstream of the first and second sheet transporting members for feeding the sheet to the first and second sheet transporting members;

a measure for measuring a first time period in which a first specified portion of the sheet comes from the sheet feeder to a first position defined before the first sheet transporting member and a second time period in which a second specified portion of the sheet comes from the sheet feeder to a second position defined before the second sheet transporting member;

a judger for judging whether a difference between the first and second time periods is larger than a predetermined value; and a controller in responsive to the judger for controlling the sheet feeder to suspend the feeding of the sheet to the first and second sheet transporting members when the difference is larger than the predetermined value.

2. A sheet transporting device as defined in claim 1, wherein the measure includes a first sheet detector provided at the first position and a second sheet detector provided at the second position.

3. A sheet transporting device as defined in claim 2, further comprising:

a first carriage for carrying the first sheet transporting member and the first sheet detector;

a second carriage for carrying the second sheet transporting member and the second sheet detector:

a moving mechanism for moving the first and second carriages in widthwise directions of the sheet.

4. A sheet transporting device as defined in claim wherein each of the first and second sheet transporting member includes a pair of endless belts.

5. A sheet transporting device for use in an image forming apparatus, the sheet transporting device comprising:

a first and second sheet transporting members movable in widthwise directions of a sheet to be transported, the first sheet transporting member for transporting the sheet in a lengthwise direction of the sheet in contact with one side end portion of the sheet, the second sheet transporting member for transporting the sheet in the lengthwise direction in contact with the other side end portion of the sheet;

a moving mechanism for moving the first and second sheet transporting members in widthwise directions of the sheet;

a sheet feeder provided at an upstream of the first and second sheet transporting members for holding the sheet temporarily and feeding the sheet to the first and second sheet transporting members; and a controller for controlling the moving mechanism and the sheet feeder to move the first and second sheet transporting members until they come into contact with the sheet while controlling the sheet feeder hold to the sheet.

6. A sheet transporting device as defined in claim 5, wherein the controller includes a first sheet detector for detecting the one side end portion of the sheet and a second sheet detector for detecting the other side end portion of the sheet, and the first and second sheet detectors are provided before the sheet feeder.

7. A sheet transporting device as defined in claim 6, wherein each of the first and second sheet detectors includes a plurality of detecting sections arranged in a widthwise direction of the sheet.

8. A sheet transporting device as defined in claim 6, further comprising:

a first carriage for carrying the first sheet transporting member and the first sheet detector:

a second carriage for carrying the second sheet transporting member and the second sheet detector:

wherein the moving mechanism includes:

a first moving portion for moving the first carriage in a first widthwise direction of the sheet; and a second moving portion for moving the second carriage in a second width direction opposite to the first widthwise direction.

9. A sheet transporting device as defined in claim 6, further comprising:

a measure for measuring a first time period in which a first specified portion of the sheet comes from the sheet feeder to a first position defined before the first sheet transporting member and a second time period in which a second specified portion of the sheet comes from the sheet feeder to a second position defined before the second sheet transporting member;

a judger for judging whether a difference between the first and second time periods is larger than a predetermined value; and a secondary controller in responsive to the judger for controlling the sheet feeder to suspend the feeding of the sheet to the first and second sheet transporting members when the difference is larger than the predetermined value.

10. A sheet transporting device as defined in claim 9, wherein the measure includes a third sheet detector provided at the first position and a fourth sheet detector provided at the second position.

11. A sheet transporting device as defined in claim 10, further comprising:

a first carriage for carrying the first sheet transporting member, the first sheet detector, and the third sheet detector;

a second carriage for carrying the second sheet transporting member, the second sheet detector, and the fourth sheet detector; and a moving mechanism for moving the first and second carriages in widthwise directions of the sheet.

12. A sheet transporting device as defined in claim 5, wherein each of the first and second sheet transporting member includes a pair of endless belts.

* * * * *